US012778188B2

(12) United States Patent
Bertoldo et al.

(10) Patent No.: US 12,778,188 B2
(45) Date of Patent: Nov. 3, 2026

(54) AEROSOL-GENERATING ARTICLE INCLUDING UPSTREAM ELEMENT

(71) Applicant: Philip Morris Products S.A., Neuchatel (CH)

(72) Inventors: Massimiliano Bertoldo, Castel Maggiore (IT); Gianpaolo D'Ambra, Castel Maggiore (IT); Edoardo Montanari, Bologna (IT); Ivan Prestia, Calderara di Reno (IT); Paola Orsolini, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 708 days.

(21) Appl. No.: 17/904,754

(22) PCT Filed: Feb. 24, 2021

(86) PCT No.: PCT/EP2021/054551
§ 371 (c)(1),
(2) Date: Aug. 22, 2022

(87) PCT Pub. No.: WO2021/170651
PCT Pub. Date: Sep. 2, 2021

(65) Prior Publication Data

US 2023/0049506 A1 Feb. 16, 2023

(30) Foreign Application Priority Data

Feb. 28, 2020 (EP) ..... 20160254

(51) Int. Cl.
*A24D 1/20* (2020.01)
*A24B 15/167* (2020.01)
(Continued)

(52) U.S. Cl.
CPC ..... *A24D 1/20* (2020.01); *A24B 15/167* (2016.11); *A24D 1/02* (2013.01); *A24D 1/042* (2013.01);
(Continued)

(58) Field of Classification Search
None
See application file for complete search history.

(56) References Cited

U.S. PATENT DOCUMENTS 5,724,998 A 3/1998 Gellatly et al.
2014/0305448 A1 10/2014 Zuber et al.
(Continued)

FOREIGN PATENT DOCUMENTS

CN 108601407 A 9/2018
CN 108669662 A 10/2018
(Continued)

OTHER PUBLICATIONS

International Search Report and Written Opinion issued May 11, 2021 in PCT/EP2021/054551, filed on Feb. 24, 2021, 11 pages.
(Continued)

*Primary Examiner* — Philip Y Louie
*Assistant Examiner* — Madeleine P Delacruz
(74) *Attorney, Agent, or Firm* — Oblon, McClelland, Maier & Neustadt, L.L.P.

(57) ABSTRACT

An aerosol-generating article is provided for producing an inhalable aerosol upon heating, the aerosol-generating article including: a rod of aerosol-generating substrate including a gel composition, the gel composition including at least one gelling agent, at least one of an alkaloid compound, and a cannabinoid compound, and at least 50 percent by weight of an aerosol former; an upstream element upstream of the rod of aerosol-generating substrate and abutting the upstream end of the rod of aerosol-generating
(Continued)

Figure 1:
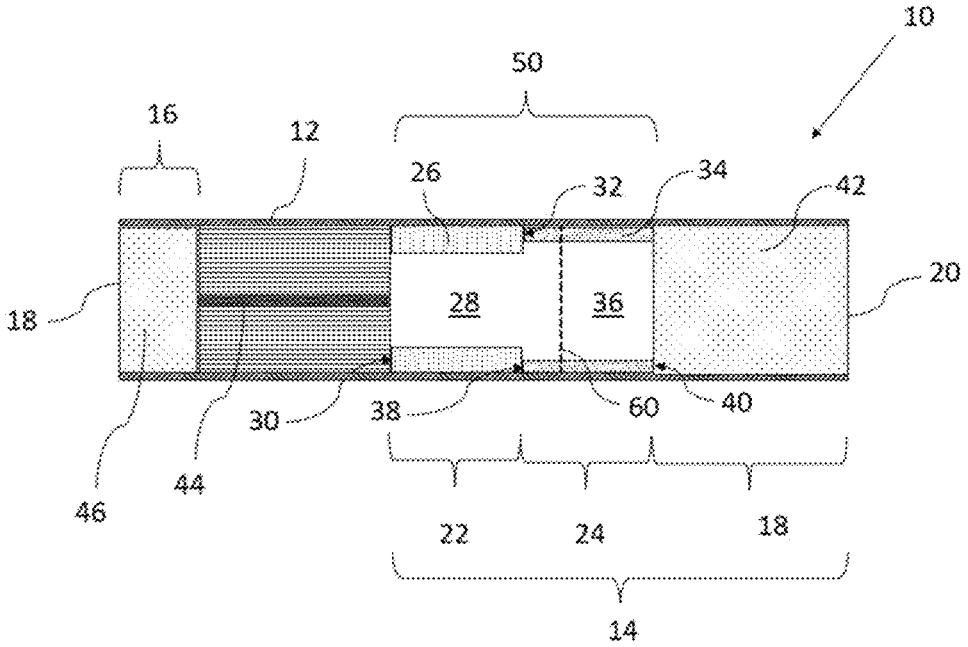

substrate, in which a resistance-to-draw (RTD) of the upstream element is between 5 millimetres $H_2O$ and 80 millimetres $H_2O$; and a downstream section arranged downstream of the rod of aerosol-generating substrate and in axial alignment with the rod of aerosol-generating substrate, the downstream section including one or more downstream elements.

17 Claims, 1 Drawing Sheet

(51) Int. Cl.

| | |
|---|---|
| ***A24D 1/02*** | (2006.01) |
| ***A24D 1/04*** | (2006.01) |
| ***A24D 1/18*** | (2006.01) |
| ***A24D 3/17*** | (2020.01) |

(52) U.S. Cl.
CPC ..... *A24D 1/045* (2013.01); *A24D 1/18* (2013.01); *A24D 3/17* (2020.01)

(56) References Cited

U.S. PATENT DOCUMENTS

| | | | | |
|---|---|---|---|---|
| 2014/0373856 | A1* | 12/2014 | Zuber | A24F 47/00 131/328 |
| 2016/0128378 | A1 | 5/2016 | Kuersteiner et al. | |
| 2016/0150825 | A1* | 6/2016 | Mironov | H05B 6/105 219/634 |
| 2017/0086508 | A1 | 3/2017 | Mironov et al. | |
| 2018/0007972 | A1 | 1/2018 | Thorens | |
| 2018/0007973 | A1 | 1/2018 | Thorens | |
| 2018/0007974 | A1 | 1/2018 | Thorens | |
| 2018/0015237 | A1 | 1/2018 | Thorens | |
| 2018/0029782 | A1 | 2/2018 | Zuber et al. | |
| 2018/0352862 | A1 | 12/2018 | Mironov et al. | |
| 2019/0075845 | A1 | 3/2019 | Malgat et al. | |
| 2020/0060351 | A1 | 2/2020 | Thorens | |
| 2021/0015144 | A1 | 1/2021 | Capelli et al. | |
| 2021/0015746 | A1 | 1/2021 | Capelli et al. | |
| 2021/0085666 | A1 | 3/2021 | Capelli et al. | |
| 2022/0353958 | A1* | 11/2022 | Rossoll | A24F 40/53 |
| 2024/0188625 | A1* | 6/2024 | Holford | A24D 3/061 |

FOREIGN PATENT DOCUMENTS

| | | | | |
|---|---|---|---|---|
| CN | 109068741 | A | 12/2018 | |
| CN | 109414072 | A | 3/2019 | |
| EP | 0 822 760 | A2 | 2/1998 | |
| EP | 2 712 510 | B1 | 3/2016 | |
| EP | 3 243 393 | A1 | 11/2017 | |
| JP | H5-153946 | A | 6/1993 | |
| JP | 2007-259864 | A | 10/2007 | |
| JP | 2007-267749 | A | 10/2007 | |
| JP | 2017-519493 | A | 7/2017 | |
| JP | 2018-511316 | A | 4/2018 | |
| JP | 2018-515119 | A | 6/2018 | |
| JP | 2019-512235 | A | 5/2019 | |
| RU | 2 602 969 | C2 | 11/2016 | |
| WO | WO 96/32854 | A2 | 10/1996 | |
| WO | WO 2012/164009 | A2 | 12/2012 | |
| WO | WO 2013/098405 | A2 | 7/2013 | |
| WO | WO 2015/176898 | A1 | 11/2015 | |
| WO | WO 2016/156219 | A1 | 10/2016 | |
| WO | WO 2016/156223 | A1 | 10/2016 | |
| WO | WO 2017/153443 | A1 | 9/2017 | |
| WO | WO 2017/207586 | A1 | 12/2017 | |
| WO | WO 2017/207672 | A1 | 12/2017 | |
| WO | WO 2018/019578 | A1 | 2/2018 | |
| WO | WO 2018/224679 | A1 | 12/2018 | |
| WO | WO-2018220558 | A1 * | 12/2018 | A24F 40/65 |
| WO | WO2019/106040 | A1 | 6/2019 | |
| WO | WO 2019122121 | A1 | 6/2019 | |
| WO | WO 2019/193208 | A1 | 10/2019 | |
| WO | WO 2019/193209 | A1 | 10/2019 | |
| WO | WO 2019/193210 | A1 | 10/2019 | |
| WO | WO 2019/220904 | A1 | 11/2019 | |
| WO | WO 2019/224073 | A1 | 11/2019 | |
| WO | WO 2020/025723 | A1 | 2/2020 | |
| WO | WO 2020/025726 | A1 | 2/2020 | |
| WO | WO 2020/025732 | A1 | 2/2020 | |
| WO | WO 2020/127102 | A2 | 6/2020 | |
| WO | WO 2020/127107 | A1 | 6/2020 | |
| WO | WO 2020/127111 | A2 | 6/2020 | |
| WO | WO 2020/127116 | A2 | 6/2020 | |
| WO | WO 2020/128043 | A1 | 6/2020 | |
| WO | WO 2020/128045 | A1 | 6/2020 | |
| WO | WO 2020/128048 | A1 | 6/2020 | |
| WO | WO 2021/110541 | A1 | 6/2021 | |

OTHER PUBLICATIONS

Combined Russian Office Action and Search Report issued Jul. 11, 2024 in Russian Patent Application No. 2022125111/03 (with English Translation of Category of Cited Documents), 11 pages.
Extended European Search Report issued Aug. 31, 2020 in European Patent Application No. 20160254.7, 8 pages.
Japanese Office Action issued Feb. 20, 2025, in corresponding Japanese Patent Application No. 2022-551668 (with English Translation), 9 pages.
Japanese Office Action issued Aug. 14. 2025 in corresponding Japanese Patent Application No. 2022-551668, with English Machine Translation, 9 pages.
Combined Chinese Office Action and Search Report issued Feb. 9, 2026, in corresponding Chinese Patent Application No. 202180017071.0 (with English Translation), 12 pages.
Japanese Office Action issued Feb. 9, 2026, in corresponding Japanese Patent Application No. 2022-551668 (with English Translation), 6 pages.
Office Action and Search Report dated Aug. 4, 2026 issued in corresponding Chinese Patent Application No. 202180017071.0.
Office Action dated Sep. 1, 2026 issued in corresponding Indian Patent Application No. 202217055290.
Office Action dated Sep. 23, 2026 issued in corresponding Canadian Patent Application No. 3168166.

* cited by examiner

AEROSOL-GENERATING ARTICLE INCLUDING UPSTREAM ELEMENT

The present invention relates to an aerosol-generating article comprising an aerosol-generating substrate and adapted to produce an inhalable aerosol upon heating.

Aerosol-generating articles in which an aerosol-generating substrate, such as a tobacco-containing substrate, is heated rather than combusted, are known in the art. Typically, in such heated smoking articles an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article. For example, electrically heated aerosol-generating devices have been proposed that comprise an internal heater blade which is adapted to be inserted into the aerosol-generating substrate. As an alternative, inductively heatable aerosol-generating articles comprising an aerosol-generating substrate and a susceptor element arranged within the aerosol-generating substrate have been proposed by WO 2015/176898.

Aerosol-generating articles in which a tobacco-containing substrate is heated rather than combusted present a number of challenges that were not encountered with conventional smoking articles. First of all, tobacco-containing substrates are typically heated to significantly lower temperatures compared with the temperatures reached by the combustion front in a conventional cigarette. This may have an impact on nicotine release from the tobacco-containing substrate and nicotine delivery to the consumer. At the same time, if the heating temperature is increased in an attempt to boost nicotine delivery, then the aerosol generated typically needs to be cooled to a greater extent and more rapidly before it reaches the consumer. However, technical solutions that were commonly used for cooling the mainstream smoke in conventional smoking articles, such as the provision of a high filtration efficiency segment at the mouth end of a cigarette, may have undesirable effects in an aerosol-generating article wherein a tobacco-containing substrate is heated rather than combusted, as they may reduce nicotine delivery. Secondly, a need is generally felt for aerosol-generating articles that are easy to use and have improved practicality.

Therefore, it would be desirable to provide a new and improved aerosol-generating article adapted to achieve at least one of the desirable results described above. Further, it would be desirable to provide one such aerosol-generating article that can be manufactured efficiently and at high speed, preferably with a satisfactory RTD and low RTD variability from one article to another.

The present disclosure relates to an aerosol-generating article comprising a rod of aerosol-generating substrate. The rod of aerosol-generating substrate may comprise a gel composition. The gel composition may comprise at least one gelling agent, at least one of an alkaloid compound and a cannabinoid compound, and an aerosol former. The aerosol-generating article may further comprise an upstream element upstream of the rod of aerosol-generating substrate and abutting the upstream end of the rod of aerosol-generating substrate. The aerosol-generating article may further comprise a downstream section arranged downstream of the rod of aerosol-generating substrate and in axial alignment with the rod of aerosol-generating substrate. The downstream section may comprise one or more downstream elements.

According to the invention there is provided an aerosol-generating article for producing an inhalable aerosol upon heating, the aerosol-generating article comprising: a rod of aerosol-generating substrate comprising a gel composition, the gel composition comprising at least one gelling agent, at least one of an alkaloid compound and a cannabinoid compound, and an aerosol former; an upstream element upstream of the rod of aerosol-generating substrate and abutting the upstream end of the rod of aerosol-generating substrate; and a downstream section arranged downstream of the rod of aerosol-generating substrate and in axial alignment with the rod of aerosol-generating substrate, the downstream section comprising one or more downstream elements.

The term "aerosol-generating article" is used herein to denote an article wherein an aerosol-generating substrate is heated to produce an deliver inhalable aerosol to a consumer. As used herein, the term "aerosol-generating substrate" denotes a substrate capable of releasing volatile compounds upon heating to generate an aerosol.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast, in heated aerosol-generating articles, an aerosol is generated by heating a flavour generating substrate, such as tobacco. Known heated aerosol-generating articles include, for example, electrically heated aerosol-generating articles and aerosol-generating articles in which an aerosol is generated by the transfer of heat from a combustible fuel element or heat source to a physically separate aerosol forming material. For example, aerosol-generating articles according to the invention find particular application in aerosol-generating systems comprising an electrically heated aerosol-generating device having an internal heater blade which is adapted to be inserted into the rod of aerosol-generating substrate. Aerosol-generating articles of this type are described in the prior art, for example, in EP 0822670.

As used herein, the term "aerosol-generating device" refers to a device comprising a heater element that interacts with the aerosol-generating substrate of the aerosol-generating article to generate an aerosol.

As used herein with reference to the present invention, the term "rod" is used to denote a generally cylindrical element of substantially circular, oval or elliptical cross-section.

As used herein, the term "longitudinal" refers to the direction corresponding to the main longitudinal axis of the aerosol-generating article, which extends between the upstream and downstream ends of the aerosol-generating article. As used herein, the terms "upstream" and "downstream" describe the relative positions of elements, or portions of elements, of the aerosol-generating article in relation to the direction in which the aerosol is transported through the aerosol-generating article during use.

During use, air is drawn through the aerosol-generating article in the longitudinal direction. The term "transverse" refers to the direction that is perpendicular to the longitudinal axis. Any reference to the "cross-section" of the aerosol-generating article or a component of the aerosol-generating article refers to the transverse cross-section unless stated otherwise.

The term "length" denotes the dimension of a component of the aerosol-generating article in the longitudinal direction. For example, it may be used to denote the dimension of the rod or of the elongate tubular elements in the longitudinal direction.

The aerosol-generating article according to the present invention, as defined above, provides an improved configuration of elements, including a combination of an aerosol-generating substrate comprising a gel composition with an upstream element, which is provided adjacent to and upstream of the rod of aerosol-generating substrate.

The use of an aerosol-generating substrate formed with a gel composition for forming the aerosol upon heating is desirable because it provides a uniform substrate that can generate a highly consistent aerosol.

The provision of an upstream element advantageously protects the rod of aerosol-generating substrate and prevents physical contact with the gel composition within the rod of aerosol-generating substrate and a susceptor element where present.

Furthermore, the upstream element can be used to provide greater control over the overall resistance to draw (RTD) of the aerosol-generating article. In particular, the upstream element can advantageously be used to compensate for potential reductions in RTD due to evaporation of the gel composition during use, or due to the inclusion of other elements in the aerosol-generating article having a relatively low resistance to draw. For example, in embodiments of the present invention including an intermediate hollow section which contributes virtually no RTD to the overall article, the upstream element can be used to add RTD to the aerosol-generating article such that an acceptable level can still be provided.

Advantageously, the upstream element can provide an increase in the overall RTD without impacting the properties of the aerosol, due to the location of the upstream element upstream of the rod of aerosol-generating substrate. If the desired level of RTD can be provided in large part due to the upstream element, this enables downstream elements to be used that provide minimal filtration of the aerosol. The aerosol-generating article can therefore optimise aerosol delivery from the gel composition to the consumer whilst still retaining an optimal level of RTD throughout the smoking experience.

Alternatively or in addition, the upstream element can advantageously be adapted to compensate for reduction in length of other elements of the aerosol-generating article so that an overall consistent length of the aerosol-generating article can be retained. As above, this compensation in length can be provided without impacting the properties of the aerosol. For example, in certain preferred embodiments of the invention in which an aerosol-cooling element is provided, the length of the aerosol-cooling element is preferably reduced compared to prior art articles and this reduction in length can be compensated for by the upstream element.

Furthermore, the upstream element may advantageously provide a more uniform appearance at the upstream end of the aerosol-generating article. This may be particularly desirable in embodiments in which a susceptor element is included in the rod of aerosol-generating substrate.

In accordance with the present invention there is provided an aerosol-generating article for generating an inhalable aerosol upon heating. The aerosol-generating article comprises a rod of aerosol-generating substrate. The aerosol-generating article further comprises a downstream section at a location downstream of the rod of aerosol-generating substrate. The downstream section comprises one or more downstream elements.

In the aerosol-generating article according to the present invention, the downstream section may comprise a mouthpiece element. The mouthpiece element may extend all the way to a mouth end of the aerosol-generating article. The downstream section may further comprise an intermediate hollow section between the mouthpiece element and the rod of aerosol-generating substrate. The intermediate hollow section may comprise an aerosol-cooling element. The aerosol-cooling element may comprise a hollow tubular segment. Alternatively or in addition, the intermediate hollow section may comprise a support element, which may comprise a hollow tubular segment.

As used herein, the term "hollow tubular segment" is used to denote a generally elongate element defining a lumen or airflow passage along a longitudinal axis thereof. In particular, the term "tubular" will be used in the following with reference to a tubular element having a substantially cylindrical cross-section and defining at least one airflow conduit establishing an uninterrupted fluid communication between an upstream end of the tubular element and a downstream end of the tubular element. However, it will be understood that alternative geometries (for example, alternative cross-sectional shapes) of the tubular segment may be possible.

As used herein, the term "elongate" means that an element has a length dimension that is greater than its width dimension or its diameter dimension, for example twice or more its width dimension or its diameter dimension.

In the context of the present invention a hollow tubular segment provides an unrestricted flow channel. This means that the hollow tubular segment provides a negligible level of resistance to draw (RTD). The flow channel should therefore be free from any components that would obstruct the flow of air in a longitudinal direction. Preferably, the flow channel is substantially empty.

In some embodiments, the aerosol-generating article may comprise a ventilation zone at a location along the downstream section. In more detail, the aerosol-generating article may comprise a ventilation zone at a location along the aerosol-cooling element. In preferred embodiments, the aerosol-cooling element comprises or is in the form of a hollow tubular segment, the ventilation zone being provided at a location along the hollow tubular segment of the aerosol-cooling element.

The aerosol-generating article according to the invention comprise an upstream section at a location upstream of the rod of aerosol-generating substrate and abutting the upstream end of the rod of aerosol-generating substrate. The upstream section may comprise one or more upstream elements. In some embodiments, the upstream section may comprise an upstream element arranged immediately upstream of the rod of aerosol-generating substrate.

The aerosol-generating article may further comprise a susceptor element within the aerosol-generating substrate. In some embodiments, the susceptor element may be an elongate susceptor element. In preferred embodiments, the susceptor element extend longitudinally within the aerosol-generating substrate.

These elements of the aerosol-generating article will be described in further detail below.

As defined above, the aerosol-generating article of the present invention comprises a rod of an aerosol-generating substrate. The aerosol-generating substrate may be a solid aerosol-generating substrate.

According to the present invention, the aerosol-generating substrate comprises a gel composition that includes an alkaloid compound, or a cannabinoid compound, or both an alkaloid compound and a cannabinoid compound. In particularly preferred embodiments, the aerosol-generating substrate comprises a gel composition that includes nicotine.

Preferably, the gel composition comprises an alkaloid compound, or a cannabinoid compound, or both an alkaloid compound and a cannabinoid compound; an aerosol former; and at least one gelling agent. Preferably, the at least one gelling agent forms a solid medium and the glycerol is dispersed in the solid medium, with the alkaloid or cannabinoid dispersed in the glycerol. Preferably, the gel composition is a stable gel phase.

Advantageously, a stable gel composition comprising nicotine provides predictable composition form upon storage or transit from manufacture to the consumer. The stable gel composition comprising nicotine substantially maintains its shape. The stable gel composition comprising nicotine substantially does not release a liquid phase upon storage or transit from manufacture to the consumer. The stable gel composition comprising nicotine may provide for a simple consumable design. This consumable may not have to be designed to contain a liquid, thus a wider range of materials and container constructions may be contemplated.

The gel composition described herein may be combined with an aerosol-generating device to provide a nicotine aerosol to the lungs at inhalation or air flow rates that are within conventional smoking regime inhalation or air flow rates. The aerosol-generating device may continuously heat the gel composition. A consumer may take a plurality of inhalations or "puffs" where each "puff" delivers an amount of nicotine aerosol. The gel composition may be capable of delivering a high nicotine/low total particulate matter (TPM) aerosol to a consumer when heated, preferably in a continuous manner.

The phrase "stable gel phase" or "stable gel" refers to gel that substantially maintains its shape and mass when exposed to a variety of environmental conditions. The stable gel may not substantially release (sweat) or absorb water when exposed to a standard temperature and pressure while varying relative humidity from about 10 percent to about 60 percent. For example, the stable gel may substantially maintain its shape and mass when exposed to a standard temperature and pressure while varying relative humidity from about 10 percent to about 60 percent.

The gel composition includes an alkaloid compound, or a cannabinoid compound, or both an alkaloid compound and a cannabinoid compound. The gel composition may include one or more alkaloids. The gel composition may include one or more cannabinoids. The gel composition may include a combination of one or more alkaloids and one or more cannabinoids.

The term "alkaloid compound" refers to any one of a class of naturally occurring organic compounds that contain one or more basic nitrogen atoms. Generally, an alkaloid contains at least one nitrogen atom in an amine-type structure. This or another nitrogen atom in the molecule of the alkaloid compound can be active as a base in acid-base reactions. Most alkaloid compounds have one or more of their nitrogen atoms as part of a cyclic system, such as for example a heterocylic ring. In nature, alkaloid compounds are found primarily in plants, and are especially common in certain families of flowering plants. However, some alkaloid compounds are found in animal species and fungi. In this disclosure, the term "alkaloid compound" refers to both naturally derived alkaloid compounds and synthetically manufactured alkaloid compounds.

The gel composition may preferably include an alkaloid compound selected from the group consisting of nicotine, anatabine, and combinations thereof.

Preferably the gel composition includes nicotine.

The term "nicotine" refers to nicotine and nicotine derivatives such as free-base nicotine, nicotine salts and the like.

The term "cannabinoid compound" refers to any one of a class of naturally occurring compounds that are found in parts of the *cannabis* plant—namely the species *Cannabis sativa, Cannabis indica*, and *Cannabis ruderalis*. Cannabinoid compounds are especially concentrated in the female flower heads. Cannabinoid compounds naturally occurring in the *cannabis* plant include cannabidiol (CBD) and tetrahydrocannabinol (THC). In this disclosure, the term "cannabinoid compounds" is used to describe both naturally derived cannabinoid compounds and synthetically manufactured cannabinoid compounds.

The gel may include a cannabinoid compound selected from the group consisting of cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabielsoin (CBE), cannabicitran (CBT), and combinations thereof.

The gel composition may preferably include a cannabinoid compound selected from the group consisting of cannabidiol (CBD), THC (tetrahydrocannabinol) and combinations thereof.

The gel may preferably include cannabidiol (CBD).

The gel composition may include nicotine and cannabidiol (CBD).

The gel composition may include nicotine, cannabidiol (CBD), and THC (tetrahydrocannabinol).

The gel composition preferably includes about 0.5 percent by weight to about 10 percent by weight of an alkaloid compound, or about 0.5 percent by weight to about 10 percent by weight. of a cannabinoid compound, or both an alkaloid compound and a cannabinoid compound in a total amount from about 0.5 percent by weight to about 10 percent by weight. The gel composition may include about 0.5 percent by weight to about 5 percent by weight of an alkaloid compound, or about 0.5 percent by weight to about 5 percent by weight of a cannabinoid compound, or both an alkaloid compound and a cannabinoid compound in a total amount from about 0.5 percent by weight to about 5 percent by weight. Preferably the gel composition includes about 1 percent by weight to about 3 percent by weight of an alkaloid compound, or about 1 percent by weight to about 3 percent by weight of a cannabinoid compound, or both an alkaloid compound and a cannabinoid compound in a total amount from about 1 percent by weight to about 3 percent by weight. The gel composition may preferably include about 1.5 percent by weight to about 2.5 percent by weight of an alkaloid compound, or about 1.5 percent by weight to about 2.5 percent by weight of a cannabinoid compound, or both an alkaloid compound and a cannabinoid compound in a total amount from about 1.5 percent by weight to about 2.5 percent by weight. The gel composition may preferably include about 2 percent by weight of an alkaloid compound, or about 2 percent by weight of a cannabinoid compound, or both an alkaloid compound and a cannabinoid compound in a total amount of about 2 percent by weight. The alkaloid compound component of the gel formulation may be the most volatile component of the gel formulation. In some aspects water may be the most volatile component of the gel formulation and the alkaloid compound component of the gel formulation may be the second most volatile component of the gel formulation. The cannabinoid compound component of the gel formulation may be the most volatile component of the gel formulation. In some aspects water may be the most volatile component of the gel formulation and the alkaloid compound component of the gel formulation may be the second most volatile component of the gel formulation.

Preferably nicotine is included in the gel compositions. The nicotine may be added to the composition in a free base form or a salt form. The gel composition includes about 0.5 percent by weight to about 10 percent by weight nicotine, or about 0.5 percent by weight to about 5 percent by weight nicotine. Preferably the gel composition includes about 1 percent by weight to about 3 percent by weight nicotine, or about 1.5 percent by weight to about 2.5 percent by weight nicotine, or about 2 percent by weight nicotine. The nicotine component of the gel formulation may be the most volatile component of the gel formulation. In some aspects water may be the most volatile component of the gel formulation and the nicotine component of the gel formulation may be the second most volatile component of the gel formulation.

The gel composition additionally includes an aerosol-former. Ideally the aerosol-former is substantially resistant to thermal degradation at the operating temperature of the associated aerosol-generating device. Suitable aerosol-formers include, but are not limited to: polyhydric alcohols, such as triethylene glycol, 1, 3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Polyhydric alcohols or mixtures thereof, may be one or more of triethylene glycol, 1, 3-butanediol and, glycerine (glycerol or propane-1,2,3-triol) or polyethylene glycol. The aerosol-former is preferably glycerol.

The gel composition may include a majority of an aerosol-former. The gel composition may include a mixture of water and the aerosol-former where the aerosol-former forms a majority (by weight) of the gel composition. The aerosol-former may form at least about 50 percent by weight of the gel composition. The aerosol-former may form at least about 60 percent by weight or at least about 65 percent by weight or at least about 70 percent by weight of the gel composition. The aerosol-former may form about 70 percent by weight to about 80 percent by weight of the gel composition. The aerosol-former may form about 70 percent by weight to about 75 percent by weight of the gel composition.

The gel composition may include a majority of glycerol. The gel composition may include a mixture of water and the glycerol where the glycerol forms a majority (by weight) of the gel composition. The glycerol may form at least about 50 percent by weight of the gel composition. The glycerol may form at least about 60 percent by weight or at least about 65 percent by weight or at least about 70 percent by weight of the gel composition. The glycerol may form about 70 percent by weight to about 80 percent by weight of the gel composition. The glycerol may form about 70 percent by weight to about 75 percent by weight of the gel composition.

The gel composition additionally includes at least one gelling agent. Preferably, the gel composition includes a total amount of gelling agents in a range from about 0.4 percent by weight to about 10 percent by weight. More preferably, the composition includes the gelling agents in a range from about 0.5 percent by weight to about 8 percent by weight. More preferably, the composition includes the gelling agents in a range from about 1 percent by weight to about 6 percent by weight. More preferably, the composition includes the gelling agents in a range from about 2 percent by weight to about 4 percent by weight. More preferably, the composition includes the gelling agents in a range from about 2 percent by weight to about 3 percent by weight.

The term "gelling agent" refers to a compound that homogeneously, when added to a 50 percent by weight water/50 percent by weight glycerol mixture, in an amount of about 0.3 percent by weight, forms a solid medium or support matrix leading to a gel. Gelling agents include, but are not limited to, hydrogen-bond crosslinking gelling agents, and ionic crosslinking gelling agents.

The gelling agent may include one or more biopolymers. The biopolymers may be formed of polysaccharides.

Biopolymers include, for example, gellan gums (native, low acyl gellan gum, high acyl gellan gums with low acyl gellan gum being preferred), xanthan gum, alginates (alginic acid), agar, guar gum, and the like. The composition may preferably include xanthan gum. The composition may include two biopolymers. The composition may include three biopolymers. The composition may include the two biopolymers in substantially equal weights. The composition may include the three biopolymers in substantially equal weights.

Preferably, the gel composition comprises at least about 0.2 percent by weight hydrogen-bond crosslinking gelling agent. Alternatively or in addition, the gel composition preferably comprises at least about 0.2 percent by weight ionic crosslinking gelling agent. Most preferably, the gel composition comprises at least about 0.2 percent by weight hydrogen-bond crosslinking gelling agent and at least about 0.2 percent by weight ionic crosslinking gelling agent. The gel composition may comprise about 0.5 percent by weight to about 3 percent by weight hydrogen-bond crosslinking gelling agent and about 0.5 percent by weight to about 3 percent by weight ionic crosslinking gelling agent, or about 1 percent by weight to about 2 percent by weight hydrogen-bond crosslinking gelling agent and about 1 percent by weight to about 2 percent by weight ionic crosslinking gelling agent. The hydrogen-bond crosslinking gelling agent and ionic crosslinking gelling agent may be present in the gel composition in substantially equal amounts by weight.

The term "hydrogen-bond crosslinking gelling agent" refers to a gelling agent that forms non-covalent crosslinking bonds or physical crosslinking bonds via hydrogen bonding. Hydrogen bonding is a type of electrostatic dipole-dipole attraction between molecules, not a covalent bond to a hydrogen atom. It results from the attractive force between a hydrogen atom covalently bonded to a very electronegative atom such as a N, O, or F atom and another very electronegative atom.

The hydrogen-bond crosslinking gelling agent may include one or more of a galactomannan, gelatin, agarose, or konjac gum, or agar. The hydrogen-bond crosslinking gelling agent may preferably include agar.

The gel composition preferably includes the hydrogen-bond crosslinking gelling agent in a range from about 0.3 percent by weight to about 5 percent by weight. Preferably the composition includes the hydrogen-bond crosslinking gelling agent in a range from about 0.5 percent by weight to about 3 percent by weight. Preferably the composition includes the hydrogen-bond crosslinking gelling agent in a range from about 1 percent by weight to about 2 percent by weight.

The gel composition may include a galactomannan in a range from about 0.2 percent by weight to about 5 percent by weight. Preferably the galactomannan may be in a range from about 0.5 percent by weight to about 3 percent by weight. Preferably the galactomannan may be in a range from about 0.5 percent by weight to about 2 percent by weight. Preferably the galactomannan may be in a range from about 1 percent by weight to about 2 percent by weight.

The gel composition may include a gelatin in a range from about 0.2 percent by weight to about 5 percent by weight. Preferably the gelatin may be in a range from about 0.5 percent by weight to about 3 percent by weight. Preferably the gelatin may be in a range from about 0.5 percent by weight to about 2 percent by weight. Preferably the gelatin may be in a range from about 1 percent by weight to about 2 percent by weight.

The gel composition may include agarose in a range from about 0.2 percent by weight to about 5 percent by weight. Preferably the agarose may be in a range from about 0.5 percent by weight to about 3 percent by weight. Preferably the agarose may be in a range from about 0.5 percent by weight to about 2 percent by weight. Preferably the agarose may be in a range from about 1 percent by weight to about 2 percent by weight.

The gel composition may include konjac gum in a range from about 0.2 percent by weight to about 5 percent by weight. Preferably the konjac gum may be in a range from about 0.5 percent by weight to about 3 percent by weight. Preferably the konjac gum may be in a range from about 0.5 percent by weight to about 2 percent by weight. Preferably the konjac gum may be in a range from about 1 percent by weight to about 2 percent by weight.

The gel composition may include agar in a range from about 0.2 percent by weight to about 5 percent by weight. Preferably the agar may be in a range from about 0.5 percent by weight to about 3 percent by weight. Preferably the agar may be in a range from about 0.5 percent by weight to about 2 percent by weight. Preferably the agar may be in a range from about 1 percent by weight to about 2 percent by weight.

The term "ionic crosslinking gelling agent" refers to a gelling agent that forms non-covalent crosslinking bonds or physical crosslinking bonds via ionic bonding. Ionic crosslinking involves the association of polymer chains by non-covalent interactions. A crosslinked network is formed when multivalent molecules of opposite charges electrostatically attract each other giving rise to a crosslinked polymeric network.

The ionic crosslinking gelling agent may include low acyl gellan, pectin, kappa carrageenan, iota carrageenan or alginate. The ionic crosslinking gelling agent may preferably include low acyl gellan.

The gel composition may include the ionic crosslinking gelling agent in a range from about 0.3 percent by weight to about 5 percent by weight. Preferably the composition includes the ionic crosslinking gelling agent in a range from about 0.5 percent by weight to about 3 percent by weight by weight. Preferably the composition includes the ionic crosslinking gelling agent in a range from about 1 percent by weight to about 2 percent by weight.

The gel composition may include low acyl gellan in a range from about 0.2 percent by weight to about 5 percent by weight. Preferably the low acyl gellan may be in a range from about 0.5 percent by weight to about 3 percent by weight. Preferably the low acyl gellan may be in a range from about 0.5 percent by weight to about 2 percent by weight. Preferably the low acyl gellan may be in a range from about 1 percent by weight to about 2 percent by weight.

The gel composition may include pectin in a range from about 0.2 percent by weight to about 5 percent by weight. Preferably the pectin may be in a range from about 0.5 percent by weight to about 3 percent by weight. Preferably the pectin may be in a range from about 0.5 percent by weight to about 2 percent by weight. Preferably the pectin may be in a range from about 1 percent by weight to about 2 percent by weight.

The gel composition may include kappa carrageenan in a range from about 0.2 percent by weight to about 5 percent by weight. Preferably the kappa carrageenan may be in a range from about 0.5 percent by weight to about 3 percent by weight. Preferably the kappa carrageenan may be in a range from about 0.5 percent by weight to about 2 percent by weight. Preferably the kappa carrageenan may be in a range from about 1 percent by weight to about 2 percent by weight.

The gel composition may include iota carrageenan in a range from about 0.2 percent by weight to about 5 percent by weight. Preferably the iota carrageenan may be in a range from about 0.5 percent by weight to about 3 percent by weight. Preferably the iota carrageenan may be in a range from about 0.5 percent by weight to about 2 percent by weight. Preferably the iota carrageenan may be in a range from about 1 percent by weight to about 2 percent by weight.

The gel composition may include alginate in a range from about 0.2 percent by weight to about 5 percent by weight. Preferably the alginate may be in a range from about 0.5 percent by weight to about 3 percent by weight. Preferably the alginate may be in a range from about 0.5 percent by weight to about 2 percent by weight. Preferably the alginate may be in a range from about 1 percent by weight to about 2 percent by weight.

The gel composition may include the hydrogen-bond crosslinking gelling agent and ionic crosslinking gelling agent in a ratio of about 3:1 to about 1:3. Preferably the gel composition may include the hydrogen-bond crosslinking gelling agent and ionic crosslinking gelling agent in a ratio of about 2:1 to about 1:2. Preferably the gel composition may include the hydrogen-bond crosslinking gelling agent and ionic crosslinking gelling agent in a ratio of about 1:1.

The gel composition may further include a viscosifying agent. The viscosifying agent combined with the hydrogen-bond crosslinking gelling agent and the ionic crosslinking gelling agent appears to surprisingly support the solid medium and maintain the gel composition even when the gel composition comprises a high level of glycerol.

The term "viscosifying agent" refers to a compound that, when added homogeneously into a 25° C., 50 percent by weight water/50 percent by weight glycerol mixture, in an amount of 0.3 percent by weight., increases the viscosity without leading to the formation of a gel, the mixture staying or remaining fluid. Preferably the viscosifying agent refers to a compound that when added homogeneously into a 25° C. 50 percent by weight water/50 percent by weight glycerol mixture, in an amount of 0.3 percent by weight, increases the viscosity to at least 50 cPs, preferably at least 200 cPs, preferably at least 500 cPs, preferably at least 1000 cPs at a shear rate of 0.1 $s^{-1}$, without leading to the formation of a gel, the mixture staying or remaining fluid. Preferably the viscosifying agent refers to a compound that when added homogeneously into a 25° C. 50 percent by weight water/50 percent by weight glycerol mixture, in an amount of 0.3 percent by weight, increases the viscosity at least 2 times, or at least 5 times, or at least 10 times, or at least 100 times higher than before addition, at a shear rate of 0.1 $s^{-1}$, without leading to the formation of a gel, the mixture staying or remaining fluid.

The viscosity values recited herein can be measured using a Brookfield RVT viscometer rotating a disc type RV #2 spindle at 25° C. at a speed of 6 revolutions per minute (rpm).

The gel composition preferably includes the viscosifying agent in a range from about 0.2 percent by weight to about 5 percent by weight. Preferably the composition includes the viscosifying agent in a range from about 0.5 percent by weight to about 3 percent by weight. Preferably the composition includes the viscosifying agent in a range from about 0.5 percent by weight to about 2 percent by weight. Preferably the composition includes the viscosifying agent in a range from about 1 percent by weight to about 2 percent by weight.

The viscosifying agent may include one or more of xanthan gum, carboxymethyl-cellulose, microcrystalline cellulose, methyl cellulose, gum Arabic, guar gum, lambda carrageenan, or starch. The viscosifying agent may preferably include xanthan gum.

The gel composition may include xanthan gum in a range from about 0.2 percent by weight to about 5 percent by weight. Preferably the xanthan gum may be in a range from about 0.5 percent by weight to about 3 percent by weight. Preferably the xanthan gum may be in a range from about 0.5 percent by weight to about 2 percent by weight. Preferably the xanthan gum may be in a range from about 1 percent by weight to about 2 percent by weight.

The gel composition may include carboxymethyl-cellulose in a range from about 0.2 percent by weight to about 5 percent by weight. Preferably the carboxymethyl-cellulose may be in a range from about 0.5 percent by weight to about 3 percent by weight. Preferably the carboxymethyl-cellulose may be in a range from about 0.5 percent by weight to about 2 percent by weight. Preferably the carboxymethyl-cellulose may be in a range from about 1 percent by weight to about 2 percent by weight.

The gel composition may include microcrystalline cellulose in a range from about 0.2 percent by weight to about 5 percent by weight. Preferably the microcrystalline cellulose may be in a range from about 0.5 percent by weight to about 3 percent by weight. Preferably the microcrystalline cellulose may be in a range from about 0.5 percent by weight to about 2 percent by weight. Preferably the microcrystalline cellulose may be in a range from about 1 percent by weight to about 2 percent by weight.

The gel composition may include methyl cellulose in a range from about 0.2 percent by weight to about 5 percent by weight. Preferably the methyl cellulose may be in a range from about 0.5 percent by weight to about 3 percent by weight. Preferably the methyl cellulose may be in a range from about 0.5 percent by weight to about 2 percent by weight. Preferably the methyl cellulose may be in a range from about 1 percent by weight to about 2 percent by weight.

The gel composition may include gum Arabic in a range from about 0.2 percent by weight to about 5 percent by weight. Preferably the gum Arabic may be in a range from about 0.5 percent by weight to about 3 percent by weight. Preferably the gum Arabic may be in a range from about 0.5 percent by weight to about 2 percent by weight. Preferably the gum Arabic may be in a range from about 1 percent by weight to about 2 percent by weight.

The gel composition may include guar gum in a range from about 0.2 percent by weight to about 5 percent by weight. Preferably the guar gum may be in a range from about 0.5 percent by weight to about 3 percent by weight. Preferably the guar gum may be in a range from about 0.5 percent by weight to about 2 percent by weight. Preferably the guar gum may be in a range from about 1 percent by weight to about 2 percent by weight.

The gel composition may include lambda carrageenan in a range from about 0.2 percent by weight to about 5 percent by weight. Preferably the lambda carrageenan may be in a range from about 0.5 percent by weight to about 3 percent by weight. Preferably the lambda carrageenan may be in a range from about 0.5 percent by weight to about 2 percent by weight. Preferably the lambda carrageenan may be in a range from about 1 percent by weight to about 2 percent by weight.

The gel composition may include starch in a range from about 0.2 percent by weight to about 5 percent by weight. Preferably the starch may be in a range from about 0.5 percent by weight to about 3 percent by weight. Preferably the starch may be in a range from about 0.5 percent by weight to about 2 percent by weight. Preferably the starch may be in a range from about 1 percent by weight to about 2 percent by weight.

The gel composition may further include a divalent cation. Preferably the divalent cation includes calcium ions, such as calcium lactate in solution. Divalent cations (such as calcium ions) may assist in the gel formation of compositions that include gelling agents such as the ionic crosslinking gelling agent, for example. The ion effect may assist in the gel formation. The divalent cation may be present in the gel composition in a range from about 0.1 to about 1 percent by weight, or about 0.5 percent by weight to about 1 percent by weight.

The gel composition may further include an acid. The acid may comprise a carboxylic acid. The carboxylic acid may include a ketone group. Preferably the carboxylic acid may include a ketone group having less than about 10 carbon atoms, or less than about 6 carbon atoms or less than about 4 carbon atoms, such as levulinic acid or lactic acid. Preferably this carboxylic acid has three carbon atoms (such as lactic acid). Lactic acid surprisingly improves the stability of the gel composition even over similar carboxylic acids. The carboxylic acid may assist in the gel formation. The carboxylic acid may reduce variation of the alkaloid compound concentration, or the cannabinoid compound concentration, or both the alkaloid compound concentration and the cannabinoid compound within the gel composition during storage. The carboxylic acid may reduce variation of the nicotine concentration within the gel composition during storage.

The gel composition may include a carboxylic acid in a range from about 0.1 percent by weight to about 5 percent by weight. Preferably the carboxylic acid may be in a range from about 0.5 percent by weight to about 3 percent by weight. Preferably the carboxylic acid may be in a range from about 0.5 percent by weight to about 2 percent by weight. Preferably the carboxylic acid may be in a range from about 1 percent by weight to about 2 percent by weight.

The gel composition may include lactic acid in a range from about 0.1 percent by weight to about 5 percent by weight. Preferably the lactic acid may be in a range from about 0.5 percent by weight to about 3 percent by weight. Preferably the lactic acid may be in a range from about 0.5 percent by weight to about 2 percent by weight. Preferably the lactic acid may be in a range from about 1 percent by weight to about 2 percent by weight.

The gel composition may include levulinic acid in a range from about 0.1 percent by weight to about 5 percent by weight. Preferably the levulinic acid may be in a range from about 0.5 percent by weight to about 3 percent by weight. Preferably the levulinic acid may be in a range from about 0.5 percent by weight to about 2 percent by weight. Preferably the levulinic acid may be in a range from about 1 percent by weight to about 2 percent by weight.

The gel composition preferably comprises some water. The gel composition is more stable when the composition comprises some water. Preferably the gel composition comprises at least about 1 percent by weight, or at least about 2 percent by weight., or at least about 5 percent by weight of water. Preferably the gel composition comprises at least about 10 percent by weight or at least about 15 percent by weight water.

Preferably the gel composition comprises between about 8 percent by weight to about 32 percent by weight water. Preferably the gel composition comprises from about 15 percent by weight to about 25 percent by weight water. Preferably the gel composition comprises from about 18 percent by weight to about 22 percent by weight water. Preferably the gel composition comprises about 20 percent by weight water.

Preferably, the aerosol-generating substrate comprises between about 150 mg and about 350 mg of the gel composition.

Preferably, the aerosol-generating substrate comprises a porous medium loaded with the gel composition. Advantages of a porous medium loaded with the gel composition is that the gel composition is retained within the porous medium, and this may aid manufacturing, storage or transport of the gel composition. It may assist in keeping the desired shape of the gel composition, especially during manufacture, transport, or use.

The term "porous" is used herein to refer to a material that provides a plurality of pores or openings that allow the passage of air through the material.

The porous medium may be any suitable porous material able to hold or retain the gel composition. Ideally the porous medium can allow the gel composition to move within it. In specific embodiments the porous medium comprises natural materials, synthetic, or semi-synthetic, or a combination thereof. In specific embodiments the porous medium comprises sheet material, foam, or fibres, for example loose fibres; or a combination thereof. In specific embodiments the porous medium comprises a woven, non-woven, or extruded material, or combinations thereof. Preferably the porous medium comprises, cotton, paper, viscose, PLA, or cellulose acetate, of combinations thereof. Preferably the porous medium comprises a sheet material, for example, cotton or cellulose acetate. In a particularly preferred embodiment, the porous medium comprises a sheet made from cotton fibres.

The porous medium used in the present invention may be crimped or shredded. In preferred embodiments, the porous medium is crimped. In alternative embodiments the porous medium comprises shredded porous medium. The crimping or shredding process can be before or after loading with the gel composition.

Crimping of the sheet material has the benefit of improving the structure to allow passageways through the structure. The passageways though the crimped sheet material assist in loading up gel, retaining gel and also for fluid to pass through the crimped sheet material. Therefore there are advantages of using crimped sheet material as the porous medium.

Shredding gives a high surface area to volume ratio to the medium thus able to absorb gel easily.

In specific embodiments the sheet material is a composite material. Preferably the sheet material is porous. The sheet material may aid manufacture of the tubular element comprising a gel. The sheet material may aid introducing an active agent to the tubular element comprising a gel. The sheet material may help stabilise the structure of the tubular element comprising a gel. The sheet material may assist transport or storage of the gel. Using a sheet material enables, or aids, adding structure to the porous medium for example by crimping of the sheet material.

The porous medium may be a thread. The thread may comprise for example cotton, paper or acetate tow. The thread may also be loaded with gel like any other porous medium. An advantage of using a thread as the porous medium is that it may aid ease of manufacturing.

The thread may be loaded with gel by any known means. The thread may be simply coated with gel, or the thread may be impregnated with gel. In the manufacture, the threads may be impregnated with gel and stored ready for use to be included in the assembly of a tubular element.

The porous medium loaded with the gel composition is preferably provided within a tubular element that forms a part of the aerosol-generating article. Ideally the tubular element may be longer in longitudinal length then in width but not necessarily as it may be one part of a multi-component item that ideally will be longer in its longitudinal length then its width. Typically, the tubular element is cylindrical but not necessarily. For example, the tubular element may have an oval, polygonal like triangular or rectangular or random cross section.

The tubular element preferably comprises a first longitudinal passageway. The tubular element is preferably formed of a wrapper that defines the first longitudinal passageway. The wrapper is preferably a water-resistant wrapper. This water-resistant property the wrapper may be achieved by using a water-resistant material, or by treating the material of the wrapper. It may be achieved by treating one side or both sides of the wrapper. Being water-resistant would assist in not losing structure, stiffness or rigidity. It may also assist in preventing leaks of gel or liquid, especially when gels of a fluid structure are used.

Preferably, the plug of porous medium loaded with the gel composition is circumscribed by a water repellent wrapper.

In certain preferred embodiments of the present invention, an elongate susceptor element is arranged substantially longitudinally within the rod of aerosol-generating substrate and is in thermal contact with the aerosol-generating substrate.

As used herein with reference to the present invention, the term "susceptor element" refers to a material that can convert electromagnetic energy into heat. When located within a fluctuating electromagnetic field, eddy currents induced in the susceptor element cause heating of the susceptor element. As the elongate susceptor element is located in thermal contact with the aerosol-generating substrate, the aerosol-generating substrate is heated by the susceptor element.

When used for describing the susceptor element, the term "elongate" means that the susceptor element has a length dimension that is greater than its width dimension or its thickness dimension, for example greater than twice its width dimension or its thickness dimension.

The susceptor element is arranged substantially longitudinally within the rod. This means that the length dimension of the elongate susceptor element is arranged to be approximately parallel to the longitudinal direction of the rod, for example within plus or minus 10 degrees of parallel to the longitudinal direction of the rod. In preferred embodiments, the elongate susceptor element may be positioned in a radially central position within the rod, and extends along the longitudinal axis of the rod.

Preferably, the susceptor element extends all the way to a downstream end of the rod of aerosol-generating article. In some embodiments, the susceptor element may extend all the way to an upstream end of the rod of aerosol-generating article. In particularly preferred embodiments, the susceptor element has substantially the same length as the rod of aerosol-generating substrate, and extends from the upstream end of the rod to the downstream end of the rod.

The susceptor element is preferably in the form of a pin, rod, strip or blade.

The susceptor element preferably has a length from about 5 millimetres to about 15 millimetres, for example from about 6 millimetres to about 12 millimetres, or from about 8 millimetres to about 10 millimetres.

A ratio between the length of the susceptor element and the overall length of the aerosol-generating article substrate may be from about 0.2 to about 0.35.

Preferably, a ratio between the length of the susceptor element and the overall length of the aerosol-generating article substrate is at least about 0.22, more preferably at least about 0.24, even more preferably at least about 0.26. A ratio between the length of the susceptor element and the overall length of the aerosol-generating article substrate is preferably less than about 0.34, more preferably less than about 0.32, even more preferably less than about 0.3.

In some embodiments, a ratio between the length of the susceptor element and the overall length of the aerosol-generating article substrate is preferably from about 0.22 to about 0.34, more preferably from about 0.24 to about 0.34, even more preferably from about 0.26 to about 0.34. In other embodiments, a ratio between the length of the susceptor element and the overall length of the aerosol-generating article substrate is preferably from about 0.22 to about 0.32, more preferably from about 0.24 to about 0.32, even more preferably from about 0.26 to about 0.32. In further embodiments, a ratio between the length of the susceptor element and the overall length of the aerosol-generating article substrate is preferably from about 0.22 to about 0.3, more preferably from about 0.24 to about 0.3, even more preferably from about 0.26 to about 0.3.

In a particularly preferred embodiment, a ratio between the length of the susceptor element and the overall length of the aerosol-generating article substrate is about 0.27.

The susceptor element preferably has a width from about 1 millimetres to about 5 millimetres.

The susceptor element may generally have a thickness from about 0.01 millimetres to about 2 millimetres, for example from about 0.5 millimetres to about 2 millimetres. In some embodiments, the susceptor element preferably has a thickness from about 10 micrometres to about 500 micrometres, more preferably from about 10 micrometres to about 100 micrometres.

If the susceptor element has a constant cross-section, for example a circular cross-section, it has a preferable width or diameter from about 1 millimetre to about 5 millimetres.

If the susceptor element has the form of a strip or blade, the strip or blade preferably has a rectangular shape having a width of preferably from about 2 millimetres to about 8 millimetres, more preferably from about 3 millimetres to about 5 millimetres. By way of example, a susceptor element in the form of a strip of blade may have a width of about 4 millimetres.

If the susceptor element has the form of a strip or blade, the strip or blade preferably has a rectangular shape and a thickness from about 0.03 millimetres to about 0.15 millimetres, more preferably from about 0.05 millimetres to about 0.09 millimetres. By way of example, a susceptor element in the form of a strip of blade may have a thickness of about 0.07 millimetres.

In a preferred embodiment, the elongate susceptor element is in the form of a strip or blade, preferably has a rectangular shape, and has a thickness from about 55 micrometres to about 65 micrometres.

More preferably, the elongate susceptor element has a thickness from about 57 micrometres to about 63 micrometres. Even more preferably, the elongate susceptor element has a thickness from about 58 micrometres to about 62 micrometres. In a particularly preferred embodiment, the elongate susceptor element has a thickness of about 60 micrometres.

Preferably, the elongate susceptor element has a length which is the same or shorter than the length of the aerosol-generating substrate. Preferably, the elongate susceptor element has a same length as the aerosol-generating substrate.

The susceptor element may be formed from any material that can be inductively heated to a temperature sufficient to generate an aerosol from the aerosol-generating substrate. Preferred susceptor elements comprise a metal or carbon.

A preferred susceptor element may comprise or consist of a ferromagnetic material, for example a ferromagnetic alloy, ferritic iron, or a ferromagnetic steel or stainless steel. A suitable susceptor element may be, or comprise, aluminium. Preferred susceptor elements may be formed from 400 series stainless steels, for example grade 410, or grade 420, or grade 430 stainless steel. Different materials will dissipate different amounts of energy when positioned within electromagnetic fields having similar values of frequency and field strength.

Thus, parameters of the susceptor element such as material type, length, width, and thickness may all be altered to provide a desired power dissipation within a known electromagnetic field. Preferred susceptor elements may be heated to a temperature in excess of 250 degrees Celsius.

Suitable susceptor elements may comprise a non-metallic core with a metal layer disposed on the non-metallic core, for example metallic tracks formed on a surface of a ceramic core. A susceptor element may have a protective external layer, for example a protective ceramic layer or protective glass layer encapsulating the susceptor element. The susceptor element may comprise a protective coating formed by a glass, a ceramic, or an inert metal, formed over a core of susceptor element material.

The susceptor element is arranged in thermal contact with the aerosol-generating substrate. Thus, when the susceptor element heats up the aerosol-generating substrate is heated up and an aerosol is formed. Preferably the susceptor element is arranged in direct physical contact with the aerosol-generating substrate, for example within the aerosol-generating substrate.

The susceptor element may be a multi-material susceptor element and may comprise a first susceptor element material and a second susceptor element material. The first susceptor element material is disposed in intimate physical contact with the second susceptor element material. The second susceptor element material preferably has a Curie temperature that is lower than 500 degrees Celsius. The first susceptor element material is preferably used primarily to heat the susceptor element when the susceptor element is placed in a fluctuating electromagnetic field. Any suitable material may be used. For example the first susceptor element material may be aluminium, or may be a ferrous material such as a stainless steel. The second susceptor element material is preferably used primarily to indicate when the susceptor element has reached a specific temperature, that temperature being the Curie temperature of the second susceptor element material. The Curie temperature of the second susceptor element material can be used to regulate the temperature of the entire susceptor element during operation. Thus, the Curie temperature of the second susceptor element material should be below the ignition point of the aerosol-generating substrate. Suitable materials for the second susceptor element material may include nickel and certain nickel alloys.

By providing a susceptor element having at least a first and a second susceptor element material, with either the second susceptor element material having a Curie temperature and the first susceptor element material not having a Curie temperature, or first and second susceptor element materials having first and second Curie temperatures distinct from one another, the heating of the aerosol-generating substrate and the temperature control of the heating may be separated. The first susceptor element material is preferably a magnetic material having a Curie temperature that is above 500 degrees Celsius. It is desirable from the point of view of heating efficiency that the Curie temperature of the first susceptor element material is above any maximum temperature that the susceptor element should be capable of being heated to. The second Curie temperature may preferably be selected to be lower than 400 degrees Celsius, preferably lower than 380 degrees Celsius, or lower than 360 degrees Celsius. It is preferable that the second susceptor element material is a magnetic material selected to have a second Curie temperature that is substantially the same as a desired maximum heating temperature. That is, it is preferable that the second Curie temperature is approximately the same as the temperature that the susceptor element should be heated to in order to generate an aerosol from the aerosol-generating substrate. The second Curie temperature may, for example, be within the range of 200 degrees Celsius to 400 degrees Celsius, or between 250 degrees Celsius and 360 degrees Celsius. The second Curie temperature of the second susceptor element material may, for example, be selected such that, upon being heated by a susceptor element that is at a temperature equal to the second Curie temperature, an overall average temperature of the aerosol-generating substrate does not exceed 240 degrees Celsius.

As defined above, the aerosol-generating articles of the present invention further comprise an upstream element located upstream of and adjacent to the aerosol-generating substrate, wherein the upstream section comprises at least one upstream element.

The upstream element may be a porous plug element. Preferably, a porous plug element does not alter the resistance to draw of the aerosol-generating article. Preferably, the upstream element has a porosity of at least about 50 percent in the longitudinal direction of the aerosol-generating article. More preferably, the upstream element has a porosity of between about 50 percent and about 90 percent in the longitudinal direction. The porosity of the upstream element in the longitudinal direction is defined by the ratio of the cross-sectional area of material forming the upstream element and the internal cross-sectional area of the aerosol-generating article at the position of the upstream element.

The upstream element may be made of a porous material or may comprise a plurality of openings. This may, for example, be achieved through laser perforation. Preferably, the plurality of openings is distributed homogeneously over the cross-section of the upstream element.

The porosity or permeability of the upstream element may advantageously be varied in order to provide a desirable overall resistance to draw of the aerosol-generating article.

Preferably, the RTD of the upstream element is at least about 5 millimetres $H_2O$. More preferably, the RTD of the upstream element is at least about 10 millimetres $H_2O$. Even more preferably, the RTD of the upstream element is at least about 15 millimetres $H_2O$. In particularly preferred embodiments, the RTD of the upstream element is at least about 20 millimetres $H_2O$.

The RTD of the upstream element is preferably less than or equal to about 80 millimetres $H_2O$. More preferably, the RTD of the upstream element is less than or equal to about 60 millimetres $H_2O$. Even more preferably, the RTD of the upstream element is less than or equal to about 40 millimetres $H_2O$.

In some embodiments, the RTD of the upstream element is from about 5 millimetres $H_2O$ to about 80 millimetres $H_2O$, preferably from about 10 millimetres $H_2O$ to about 80 millimetres $H_2O$, more preferably from about 15 millimetres $H_2O$ to about 80 millimetres $H_2O$, even more preferably from about 20 millimetres $H_2O$ to about 80 millimetres $H_2O$. In other embodiments, the RTD of the upstream element is from about 5 millimetres $H_2O$ to about 60 millimetres $H_2O$, preferably from about 10 millimetres $H_2O$ to about 60 millimetres $H_2O$, more preferably from about 15 millimetres $H_2O$ to about 60 millimetres $H_2O$, even more preferably from about 20 millimetres $H_2O$ to about 60 millimetres $H_2O$. In further embodiments, the RTD of the upstream element is from about 5 millimetres $H_2O$ to about 40 millimetres $H_2O$, preferably from about 10 millimetres $H_2O$ to about 40 millimetres $H_2O$, more preferably from about 15 millimetres $H_2O$ to about 40 millimetres $H_2O$, even more preferably from about 20 millimetres $H_2O$ to about 40 millimetres $H_2O$.

Preferably, the RTD of the upstream element is greater than the RTD of the mouthpiece element, where present. Preferably, the RTD of the upstream element is at least 1.5 times the RTD of the mouthpiece element, more preferably at least 2 times the RTD of the mouthpiece element and more preferably at least 2.5 times the RTD of the mouthpiece element. This advantageously provides a greater proportion of the overall RTD of the aerosol-generating article upstream of the rod of aerosol-generating substrate. This enables the RTD of the mouthpiece element to be minimised so that the filtration effect on the aerosol can also be minimised if desired.

In alternative embodiments, the upstream element may be formed from a material that is impermeable to air. In such embodiments, the aerosol-generating article may be configured such that air flows into the rod of aerosol-generating substrate through suitable ventilation means provided in a wrapper.

The upstream element may be made of any material suitable for use in an aerosol-generating article. The upstream element may, for example, be made of a same material as used for one of the other components of the aerosol-generating article, such as the mouthpiece, the cooling element or the support element. Suitable materials for forming the upstream element include filter materials, ceramic, polymer material, cellulose acetate, cardboard, zeolite or aerosol-generating substrate. Preferably, the upstream element is formed from a plug of cellulose acetate.

Preferably, the upstream element is formed of a heat resistant material. For example, preferably the upstream element is formed of a material that resists temperatures of up to 350 degrees Celsius. This ensures that the upstream element is not adversely affected by the heating means for heating the aerosol-generating substrate.

Preferably, the upstream element has a diameter that is approximately equal to the diameter of the aerosol-generating article.

Preferably, the upstream element has a length of between about 1 millimetre and about 10 millimetres, more preferably between about 3 millimetres and about 8 millimetres, more preferably between about 4 millimetres and about 6 millimetres. In a particularly preferred embodiment, the upstream element has a length of about 5 millimetres. The length of the upstream element can advantageously be varied in order to provide the desired total length of the aerosol-generating article. For example, where it is desired to reduce the length of one of the other components of the aerosol-generating article, the length of the upstream element may be increased in order to maintain the same overall length of the article.

The upstream element preferably has a substantially homogeneous structure. For example, the upstream element may be substantially homogeneous in texture and appearance. The upstream element may, for example, have a continuous, regular surface over its entire cross section. The upstream element may, for example, have no recognisable symmetries.

The upstream element is preferably circumscribed by a wrapper. The wrapper circumscribing the upstream element is preferably a stiff plug wrap, for example, a plug wrap having a basis weight of at least about 80 grams per square metre (gsm), or at least about 100 gsm, or at least about 110 gsm. This provides structural rigidity to the upstream element.

As defined above, the aerosol-generating article of the present invention further comprises a downstream section comprising one or more downstream elements. Preferably, the downstream section comprises a mouthpiece element. The mouthpiece element is preferably located at the downstream end or mouth end of the aerosol-generating article. The mouthpiece element preferably comprises at least one mouthpiece filter segment for filtering the aerosol that is generated from the aerosol-generating substrate. For example, the mouthpiece element may comprise one or more segments of a fibrous filtration material. Suitable fibrous filtration materials would be known to the skilled person. Particularly preferably, the at least one mouthpiece filter segment comprises a cellulose acetate filter segment formed of cellulose acetate tow.

In certain preferred embodiments, the mouthpiece element consists of a single mouthpiece filter segment. In alternative embodiments, the mouthpiece element includes two or more mouthpiece filter segments axially aligned in an abutting end to end relationship with each other.

In certain embodiments of the invention, the downstream section may comprise a mouth end cavity at the downstream end, downstream of the mouthpiece element as described above. The mouth end cavity may be defined by a hollow tubular element provided at the downstream end of the mouthpiece. Alternatively, the mouth end cavity may be defined by the outer wrapper of the mouthpiece element, wherein the outer wrapper extends in a downstream direction from the mouthpiece element.

The mouthpiece element may optionally comprise a flavourant, which may be provided in any suitable form. For example, the mouthpiece element may comprise one or more capsules, beads or granules of a flavourant, or one or more flavour loaded threads or filaments.

In an aerosol-generating article in accordance with the present invention the mouthpiece element forms a part of the downstream section and is therefore located downstream of the rod of aerosol-generating substrate.

The downstream section of the aerosol-generating article preferably further comprises a support element located immediately downstream of the rod of aerosol-generating substrate. The mouthpiece element is preferably located downstream of the support element. The downstream section preferably further comprises an aerosol-cooling element located immediately downstream of the support element. The mouthpiece element is preferably located downstream of both the support element and the aerosol-cooling element. Particularly preferably, the mouthpiece element is located immediately downstream of the aerosol-cooling element. By way of example, the mouthpiece element may abut the downstream end of the aerosol-cooling element.

Preferably, the mouthpiece element has a low particulate filtration efficiency.

Preferably, the mouthpiece element is circumscribed by a plug wrap. Preferably, the mouthpiece element is unventilated such that air does not enter the aerosol-generating article along the mouthpiece element.

The mouthpiece element is preferably connected to one or more of the adjacent upstream components of the aerosol-generating article by means of a tipping wrapper.

Preferably, the mouthpiece element has an RTD of less than about 25 millimetres $H_2O$. More preferably, the mouthpiece element has an RTD of less than about 20 millimetres $H_2O$. Even more preferably, the mouthpiece element has an RTD of less than about 15 millimetres $H_2O$.

Values of RTD from about 10 millimetres $H_2O$ to about to about 15 millimetres $H_2O$ are particularly preferred because a mouthpiece element having one such RTD is expected to contribute minimally to the overall RTD of the aerosol-generating article substantially does not exert a filtration action on the aerosol being delivered to the consumer.

The mouthpiece element preferably has an external diameter that is approximately equal to the external diameter of the aerosol-generating article. The mouthpiece element may have an external diameter of between about 5 millimetres and about 10 millimetres, or between about 6 millimetres and about 8 millimetres. In a preferred embodiment, the mouthpiece element has an external diameter of approximately 7.2 millimetres.

The mouthpiece element preferably has a length of at least about 5 millimetres, more preferably at least about 8 millimetres, more preferably at least about 10 millimetres. Alternatively or in addition, the mouthpiece element preferably has a length of less than about 25 millimetres, more preferably less than about 20 millimetres, more preferably less than about 15 millimetres.

In some embodiments, the mouthpiece element preferably has a length from about 5 millimetres to about 25 millimetres, more preferably from about 8 millimetres to about 25 millimetres, even more preferably from about 10 millimetres to about 25 millimetres. In other embodiments, the mouthpiece element preferably has a length from about 5 millimetres to about 10 millimetres, more preferably from about 8 millimetres to about 20 millimetres, even more preferably from about 10 millimetres to about 20 millimetres. In further embodiments, the mouthpiece element preferably has a length from about 5 millimetres to about 15 millimetres, more preferably from about 8 millimetres to about 15 millimetres, even more preferably from about 10 millimetres to about 15 millimetres.

For example, the mouthpiece element may have a length of between about 5 millimetres and about 25 millimetres, or between about 8 millimetres and about 20 millimetres, or between about 10 millimetres and about 15 millimetres. In a preferred embodiment, the mouthpiece element has a length of approximately 12 millimetres.

In certain preferred embodiments of the invention, the mouthpiece element has a length of at least 10 millimetres. In such embodiments, the mouthpiece element is therefore relatively long compared to the mouthpiece element provided in prior art articles. The provision of a relatively long mouthpiece element in the aerosol-generating articles of the present invention may provide several benefits to the consumer. The mouthpiece element is typically more resilient to deformation or better adapted to recover its initial shape after deformation than other elements that may be provided downstream of the rod of aerosol-generating substrate, such as an aerosol-cooling element or support element. Increasing the length of the mouthpiece element is therefore found to provide for improved grip by the consumer and to facilitate insertion of the aerosol-generating article into a heating device. A longer mouthpiece element may additionally be used to provide a higher level of filtration and removal of undesirable aerosol constituents such as phenols, so that a higher quality aerosol can be delivered. In addition, the use of a longer mouthpiece element enables a more complex mouthpiece to be provided since there is more space for the incorporation of mouthpiece components such as capsules, threads and restrictors.

In particularly preferred embodiments of the invention, a mouthpiece element having a length of at least 10 millimetres is combined with the relatively short aerosol-cooling element, having a length of less than 10 millimetres. This combination has been found to provide the aerosol-generating article with a more rigid mouth end, which reduces the risk of deformation of the aerosol-cooling element during use and to contribute to a more efficient puffing action by the consumer.

Preferably, the length of the mouthpiece element is at least 0.4 times the total length of the intermediate hollow section, preferably at least 0.5 times the length of the intermediate hollow section, more preferably at least 0.6 times the length of the intermediate hollow section, more preferably at least 0.7 times the length of the intermediate hollow section. The ratio between the length of the mouthpiece element and the total length of the intermediate hollow section is therefore at least about 0.4, preferably at least about 0.5, more preferably at least about 0.6 and most preferably at least about 0.7.

A ratio between the length of the mouthpiece element and the length of the rod of aerosol-generating substrate may be from about 0.5 to about 1.5.

Preferably, a ratio between the length of the mouthpiece element and the length of the rod of aerosol-generating substrate is at least about 0.6, more preferably at least about 0.7, even more preferably at least about 0.8. In preferred embodiments, a ratio between the length of the mouthpiece element and the length of the rod of aerosol-generating substrate is less than about 1.4, more preferably less than about 1.3, even more preferably less than about 1.2.

In some embodiments, a ratio between the length of the mouthpiece element and the length of the rod of aerosol-generating substrate is from about 0.6 to about 1.4, preferably from about 0.7 to about 1.4, more preferably from about 0.8 to about 1.4. In other embodiments, a ratio between the length of the mouthpiece element and the length of the rod of aerosol-generating substrate is from about 0.6 to about 1.3, preferably from about 0.7 to about 1.3, more preferably from about 0.8 to about 1.3. In further embodiments, a ratio between the length of the mouthpiece element and the length of the rod of aerosol-generating substrate is from about 0.6 to about 1.2, preferably from about 0.7 to about 1.2, more preferably from about 0.8 to about 1.2.

In a particularly preferred embodiments, a ratio between the length of the mouthpiece element and the length of the rod of aerosol-generating substrate is about 1.

A ratio between the length of the mouthpiece element and the overall length of the aerosol-generating article substrate may be from about 0.2 to about 0.35.

Preferably, a ratio between the length of the mouthpiece element and the overall length of the aerosol-generating article substrate is at least about 0.22, more preferably at least about 0.24, even more preferably at least about 0.26. A ratio between the length of the mouthpiece element and the overall length of the aerosol-generating article substrate is preferably less than about 0.34, more preferably less than about 0.32, even more preferably less than about 0.3.

In some embodiments, a ratio between the length of the mouthpiece element and the overall length of the aerosol-generating article substrate is preferably from about 0.22 to about 0.34, more preferably from about 0.24 to about 0.34, even more preferably from about 0.26 to about 0.34. In other embodiments, a ratio between the length of the mouthpiece element and the overall length of the aerosol-generating article substrate is preferably from about 0.22 to about 0.32, more preferably from about 0.24 to about 0.32, even more preferably from about 0.26 to about 0.32. In further embodiments, a ratio between the length of the mouthpiece element and the overall length of the aerosol-generating article substrate is preferably from about 0.22 to about 0.3, more preferably from about 0.24 to about 0.3, even more preferably from about 0.26 to about 0.3.

In a particularly preferred embodiment, a ratio between the length of the mouthpiece element and the overall length of the aerosol-generating article substrate is about 0.27.

The downstream section of the aerosol-generating articles in accordance with the present invention preferably further comprises an intermediate hollow section. The intermediate hollow section preferably comprises an aerosol-cooling element arranged in alignment with, and downstream of the rod of aerosol-generating substrate.

The aerosol-cooling element is preferably arranged substantially in alignment with the rod. This means that the length dimension of the aerosol-cooling element is arranged to be approximately parallel to the longitudinal direction of the rod and of the article, for example within plus or minus 10 degrees of parallel to the longitudinal direction of the rod. In preferred embodiments, the aerosol-cooling element extends along the longitudinal axis of the rod.

In aerosol-generating articles in accordance with the present invention the aerosol-cooling element is preferably in the form of a hollow tubular segment that defines a cavity extending all the way from an upstream end of the aerosol-cooling element to a downstream end of the aerosol-cooling element. Preferably, a ventilation zone is provided at a location along the hollow tubular segment.

The inventors have found that a satisfactory cooling of the stream of aerosol generated upon heating the aerosol-generating substrate and drawn through one such aerosol-cooling element is achieved by providing a ventilation zone at a location along the hollow tubular segment. Further, the inventors have found that, as will be described in more detail below, by arranging the ventilation zone at a precisely defined location along the length of the aerosol-cooling element and by preferably utilising a hollow tubular segment having a predetermined peripheral wall thickness or internal volume, it may be possible to counter the effects of the increased aerosol dilution caused by the admission of ventilation air into the article.

Without wishing to be bound by theory, it is hypothesised that, because the temperature of the aerosol stream is rapidly lowered by the introduction of ventilation air as the aerosol is travelling towards the mouthpiece segment, the ventilation air being admitted into the aerosol stream at a location relatively close to the upstream end of the aerosol-cooling element (that is, sufficiently close to the susceptor element extending within the rod of aerosol-generating substrate, which is the heat source during use), a dramatic cooling of the aerosol stream is achieved, which has a favourable impact on the condensation and nucleation of the aerosol particles. Accordingly, the overall proportion of the aerosol particulate phase to the aerosol gas phase may be enhanced compared with existing, non-ventilated aerosol-generating articles.

At the same time, keeping the thickness of the peripheral wall of the hollow tubular element relatively low ensures that the overall internal volume of the hollow tubular element—which is made available for the aerosol to begin the nucleation process as soon as the aerosol components leave the rod of aerosol-generating substrate—and the cross-sectional surface area of the hollow tubular segment are effectively maximised, whilst at the same time ensuring that the hollow tubular segment has the necessary structural strength to prevent a collapse of the aerosol-generating article as well as to provide some support to the rod of aerosol-generating substrate, and that the RTD of the hollow tubular segment is minimised. Greater values of cross-sectional surface area of the cavity of the hollow tubular segment are understood to be associated with a reduced speed of the aerosol stream travelling along the aerosol-generating article, which is also expected to favour aerosol nucleation. Further, it would appear that by utilising a hollow tubular segment having a relatively low thickness, it is possible to substantially prevent diffusion of the ventilation air prior to its contacting and mixing with the stream of aerosol, which is also understood to further favour nucleation phenomena. In practice, by providing a more controllably localised cooling of the stream of volatilised species, it is possible to enhance the effect of cooling on the formation of new aerosol particles.

The aerosol-cooling element preferably has an outer diameter that is approximately equal to the outer diameter of the rod of aerosol-generating substrate and to the outer diameter of the aerosol-generating article.

The aerosol-cooling element may have an outer diameter of between 5 millimetres and 12 millimetres, for example of between 5 millimetres and 10 millimetres or of between 6 millimetres and 8 millimetres. In a preferred embodiment, the aerosol-cooling element has an external diameter of 7.2 millimetres plus or minus 10 percent.

Preferably, the hollow tubular segment of the aerosol-cooling element has an internal diameter of at least about 2 millimetres. More preferably, the hollow tubular segment of the aerosol-cooling element has an internal diameter of at least about 2.5 millimetres. Even more preferably, the hollow tubular segment of the aerosol-cooling element has an internal diameter of at least about 3 millimetres.

The hollow tubular segment of the aerosol-cooling element preferably has a wall thickness of less than about 2.5 millimetres, preferably less than about 1.5 millimetres, more preferably less than about 1250 micrometres, even more preferably less than about 1000 micrometres. In particularly preferred embodiments, the hollow tube segment of the aerosol-cooling element has a wall thickness of less than about 900 micrometres, preferably less than about 800 micrometres.

In an embodiment, the hollow tubular segment of the aerosol-cooling element has a wall thickness of about 2 millimetres.

Preferably, the aerosol-cooling element has a length of at least about 5 millimetres, more preferably at least about 6 millimetres, more preferably at least about 7 millimetres.

In preferred embodiments, the aerosol-cooling element has a length of less than about 12 millimetres, more preferably less than about 10 millimetres.

In some embodiments, the aerosol-cooling element has a length from about 5 millimetres to about 15 millimetres, preferably from about 6 millimetres to about 15 millimetres, more preferably from about 7 millimetres to about 15 millimetres. In other embodiments, the aerosol-cooling element has a length from about 5 millimetres to about 12 millimetres, preferably from about 6 millimetres to about 12 millimetres, more preferably from about 7 millimetres to about 12 millimetres. In further embodiments, the aerosol-cooling element has a length from about 5 millimetres to about 10 millimetres, preferably from about 6 millimetres to about 10 millimetres, more preferably from about 7 millimetres to about 10 millimetres.

In particularly preferred embodiments of the invention, the aerosol-cooling element has a length of less than 10 millimetres. For example, in one particularly preferred embodiment, the aerosol-cooling element has a length of 8 millimetres. In such embodiments, the aerosol-cooling element therefore has a relatively short length compared to the aerosol-cooling elements of prior art aerosol-generating articles. A reduction in the length of the aerosol-cooling element is possible due to the optimised effectiveness of the hollow tubular segment forming the aerosol-cooling element in the cooling and nucleation of the aerosol. The reduction of the length of the aerosol-cooling element advantageously reduces the risk of deformation of the aerosol-generating article due to compression during use, since the aerosol-cooling element typically has a lower resistance to deformation than the mouthpiece. Furthermore, the reduction of the length of the aerosol-cooling element may provide a cost benefit to the manufacturer since the cost of a hollow tubular segment is typically higher per unit length than the cost of other elements such as a mouthpiece element.

A ratio between the length of the aerosol-cooling element and the length of the rod of aerosol-generating substrate may be from about 0.25 to about 1.

Preferably, a ratio between the length of the aerosol-cooling element and the length of the rod of aerosol-generating substrate is at least about 0.3, more preferably at least about 0.4, even more preferably at least about 0.5. In preferred embodiments, a ratio between the length of the aerosol-cooling element and the length of the rod of aerosol-generating substrate is less than about 0.9, more preferably less than about 0.8, even more preferably less than about 0.7.

In some embodiments, a ratio between the length of the aerosol-cooling element and the length of the rod of aerosol-generating substrate is from about 0.3 to about 0.9, preferably from about 0.4 to about 0.9, more preferably from about 0.5 to about 0.9. In other embodiments, a ratio between the length of the aerosol-cooling element and the length of the rod of aerosol-generating substrate is from about 0.3 to about 0.8, preferably from about 0.4 to about 0.8, more preferably from about 0.5 to about 0.8. In further embodiments, a ratio between the length of the aerosol-cooling element and the length of the rod of aerosol-generating substrate is from about 0.3 to about 0.7, preferably from about 0.4 to about 0.7, more preferably from about 0.5 to about 0.7.

In a particularly preferred embodiments, a ratio between the length of the aerosol-cooling element and the length of the rod of aerosol-generating substrate is about 0.66.

Preferably, a ratio between the length of the aerosol-cooling element and the overall length of the aerosol-generating article substrate is at least about 0.13, more preferably at least about 0.14, even more preferably at least about 0.15. A ratio between the length of the aerosol-cooling element and the overall length of the aerosol-generating article substrate is preferably less than about 0.3, more preferably less than about 0.25, even more preferably less than about 0.20.

In some embodiments, a ratio between the length of the aerosol-cooling element and the overall length of the aerosol-generating article substrate is preferably from about 0.13 to about 0.3, more preferably from about 0.14 to about 0.3, even more preferably from about 0.15 to about 0.3. In other embodiments, a ratio between the length of the aerosol-cooling element and the overall length of the aerosol-generating article substrate is preferably from about 0.13 to about 0.25, more preferably from about 0.14 to about 0.25, even more preferably from about 0.15 to about 0.25. In further embodiments, a ratio between the length of the aerosol-cooling element and the overall length of the aerosol-generating article substrate is preferably from about 0.13 to about 0.2, more preferably from about 0.14 to about 0.2, even more preferably from about 0.15 to about 0.2.

In a particularly preferred embodiment, a ratio between the length of the aerosol-cooling element and the overall length of the aerosol-generating article substrate is about 0.18.

Preferably, the length of the mouthpiece element is at least 1 millimetre greater than the length of the aerosol-cooling element, more preferably at least 2 millimetres greater than the length of the aerosol-cooling element, more preferably at least 3 millimetres greater than the length of the aerosol-cooling element. A reduction in the length of the aerosol-cooling element, as described above, can advantageously allow for an increase in the length of other elements of the aerosol-generating article, such as the mouthpiece element. The potential technical benefits of providing a relatively long mouthpiece element are described above.

A ratio between the length of the aerosol-cooling element and the length of the rod of aerosol-generating substrate may be from about 0.25 to about 1.

Preferably, a ratio between the length of the aerosol-cooling element and the length of the rod of aerosol-generating substrate is at least about 0.3, more preferably at least about 0.4, even more preferably at least about 0.5. In preferred embodiments, a ratio between the length of the aerosol-cooling element and the length of the rod of aerosol-generating substrate is less than about 0.9, more preferably less than about 0.8, even more preferably less than about 0.7.

In some embodiments, a ratio between the length of the aerosol-cooling element and the length of the rod of aerosol-generating substrate is from about 0.3 to about 0.9, preferably from about 0.4 to about 0.9, more preferably from about 0.5 to about 0.9. In other embodiments, a ratio between the length of the aerosol-cooling element and the length of the rod of aerosol-generating substrate is from about 0.3 to about 0.8, preferably from about 0.4 to about 0.8, more preferably from about 0.5 to about 0.8. In further embodiments, a ratio between the length of the aerosol-cooling element and the length of the rod of aerosol-generating substrate is from about 0.3 to about 0.7, preferably from about 0.4 to about 0.7, more preferably from about 0.5 to about 0.7.

In a particularly preferred embodiments, a ratio between the length of the aerosol-cooling element and the length of the rod of aerosol-generating substrate is about 0.66.

A ratio between the length of the aerosol-cooling element and the overall length of the aerosol-generating article substrate may be from about 0.125 to about 0.375.

Preferably, a ratio between the length of the aerosol-cooling element and the overall length of the aerosol-generating article substrate is at least about 0.13, more preferably at least about 0.14, even more preferably at least about 0.15. A ratio between the length of the aerosol-cooling element and the overall length of the aerosol-generating article substrate is preferably less than about 0.3, more preferably less than about 0.25, even more preferably less than about 0.20.

In some embodiments, a ratio between the length of the aerosol-cooling element and the overall length of the aerosol-generating article substrate is preferably from about 0.13 to about 0.3, more preferably from about 0.14 to about 0.3, even more preferably from about 0.15 to about 0.3. In other embodiments, a ratio between the length of the aerosol-cooling element and the overall length of the aerosol-generating article substrate is preferably from about 0.13 to about 0.25, more preferably from about 0.14 to about 0.25, even more preferably from about 0.15 to about 0.25. In further embodiments, a ratio between the length of the aerosol-cooling element and the overall length of the aerosol-generating article substrate is preferably from about 0.13 to about 0.2, more preferably from about 0.14 to about 0.2, even more preferably from about 0.15 to about 0.2.

In a particularly preferred embodiment, a ratio between the length of the aerosol-cooling element and the overall length of the aerosol-generating article substrate is about 0.18.

Preferably, the length of the mouthpiece element is at least 1 millimetre greater than the length of the aerosol-cooling element, more preferably at least 2 millimetres greater than the length of the aerosol-cooling element, more preferably at least 3 millimetres greater than the length of the aerosol-cooling element. A reduction in the length of the aerosol-cooling element, as described above, can advantageously allow for an increase in the length of other elements of the aerosol-generating article, such as the mouthpiece element. The potential technical benefits of providing a relatively long mouthpiece element are described above.

Preferably, in aerosol-generating articles in accordance with the present invention the aerosol-cooling element has an average radial hardness of at least about 80 percent, more preferably at least about 85 percent, even more preferably at least about 90 percent. The aerosol-cooling element is therefore able to provide a desirable level of hardness to the aerosol-generating article.

If desired, the radial hardness of the aerosol-cooling element of aerosol-generating articles in accordance with the invention may be further increased by circumscribing the aerosol-cooling element by a stiff plug wrap, for example, a plug wrap having a basis weight of at least about 80 grams per square metre (gsm), or at least about 100 gsm, or at least about 110 gsm.

As used herein, the term "radial hardness" of an element refers to resistance to compression in a direction transverse to a longitudinal axis of the element. Radial hardness of an aerosol-generating article around an element may be determined by applying a load across the article at the location of the element, transverse to the longitudinal axis of the article, and measuring the average (mean) depressed diameters of the articles. Radial hardness is given by:

$$\text{Radial hardness } (\%) = \frac{D_d}{D_S} * 100\%$$

where $D_S$ is the original (undepressed) diameter, and $D_d$ is the depressed diameter after applying a set load for a set duration. The harder the material, the closer the hardness is to 100 percent.

To determine the hardness of a portion (such as an aerosol-cooling element provided in the form of a hollow tube segment) of an aerosol article, aerosol-generating articles should be aligned parallel in a plane and the same portion of each aerosol-generating article to be tested should be subjected to a set load for a set duration. This test is performed using a known DD60A Densimeter device (manufactured and made commercially available by Heinr Borgwaldt GmbH, Germany), which is fitted with a measuring head for aerosol-generating articles, such as cigarettes, and with an aerosol-generating article receptacle.

The load is applied using two load-applying cylindrical rods, which extend across the diameter of all of the aerosol-generating articles at once. According to the standard test method for this instrument, the test should be performed such that twenty contact points occur between the aerosol-generating articles and the load applying cylindrical rods. In some cases, the hollow tube segments to be tested may be long enough such that only ten aerosol-generating articles are needed to form twenty contact points, with each smoking article contacting both load applying rods (because they are long enough to extend between the rods). In other cases, if the support elements are too short to achieve this, then twenty aerosol-generating articles should be used to form the twenty contact points, with each aerosol-generating article contacting only one of the load applying rods, as further discussed below.

Two further stationary cylindrical rods are located underneath the aerosol-generating articles, to support the aerosol-generating articles and counteract the load applied by each of the load applying cylindrical rods.

For the standard operating procedure for such an apparatus, an overall load of 2 kg is applied for a duration of 20 seconds. After 20 seconds have elapsed (and with the load still being applied to the smoking articles), the depression in the load applying cylindrical rods is determined, and then used to calculate the hardness from the above equation. The temperature is kept in the region of 22 degrees Celsius±2 degrees. The test described above is referred to as the DD60A Test. The standard way to measure the filter hardness is when the aerosol-generating article have not been consumed. Additional information regarding measurement of average radial hardness can be found in, for example, U.S. Published Patent Application Publication Number 2016/0128378.

The aerosol-cooling element may be formed from any suitable material or combination of materials. For example, the aerosol-cooling element may be formed from one or more materials selected from the group consisting of: cellulose acetate; cardboard; crimped paper, such as crimped heat resistant paper or crimped parchment paper; and polymeric materials, such as low density polyethylene (LDPE). Other suitable materials include polyhydroxyalkanoate (PHA) fibres.

In a preferred embodiment, the aerosol-cooling element is formed from cellulose acetate.

Preferably, the hollow tubular segment of the aerosol-cooling element is adapted to generate a RTD between approximately 0 millimetres $H_2O$ (about 0 Pa) to approximately 20 millimetres $H_2O$ (about 100 Pa), more preferably between approximately 0 millimetres $H_2O$ (about 0 Pa) to approximately 10 millimetres $H_2O$ (about 100 Pa).

In aerosol-generating articles in accordance with the present invention the overall RTD of the article depends essentially on the RTD of the rod and optionally on the RTD of the mouthpiece element and/or upstream plug. This is because the hollow tubular segment of the aerosol-cooling element and the hollow tubular segment of the support element are substantially empty and, as such, substantially only marginally contribute to the overall RTD of the aerosol-generating article.

The ventilation zone comprises a plurality of perforations through the peripheral wall of the aerosol-cooling element. Preferably, the ventilation zone comprises at least one circumferential row of perforations. In some embodiments, the ventilation zone may comprise two circumferential rows of perforations. For example, the perforations may be formed online during manufacturing of the aerosol-generating article. Preferably, each circumferential row of perforations comprises from 8 to 30 perforations.

An aerosol-generating article in accordance with the present invention may have a ventilation level of at least about 5 percent.

The term "ventilation level" is used throughout the present specification to denote a volume ratio between of the airflow admitted into the aerosol-generating article via the ventilation zone (ventilation airflow) and the sum of the aerosol airflow and the ventilation airflow. The greater the ventilation level, the higher the dilution of the aerosol flow delivered to the consumer.

The aerosol-generating article may typically have a ventilation level of at least about 10 percent, preferably at least about 15 percent, more preferably at least about 20 percent.

In preferred embodiments, the aerosol-generating article has a ventilation level of at least about 25 percent. The aerosol-generating article preferably has a ventilation level of less than about 60 percent. An aerosol-generating article in accordance with the present invention preferably has a ventilation level of less than or equal to about 45 percent. More preferably, an aerosol-generating article in accordance with the present invention has a ventilation level of less than or equal to about 40 percent, even more preferably less than or equal to about 35 percent.

In a particularly preferred embodiments, the aerosol-generating article has a ventilation level of about 30 percent. In some embodiments, the aerosol-generating article has a ventilation level from about 20 percent to about 60 percent, preferably from about 20 percent to about 45 percent, more preferably from about 20 percent to about 40 percent. In other embodiments, the aerosol-generating article has a ventilation level from about 25 percent to about 60 percent, preferably from about 25 percent to about 45 percent, more preferably from about 25 percent to about 40 percent. In further embodiments, the aerosol-generating article has a ventilation level from about 30 percent to about 60 percent, preferably from about 30 percent to about 45 percent, more preferably from about 30 percent to about 40 percent.

In particularly preferred embodiments, the aerosol-generating article has a ventilation level from about 28 percent to about 42 percent. In some particularly preferred embodiments, the aerosol-generating article has a ventilation level of about 30 percent.

Without wishing to be bound by theory, the inventors have found that the temperature drop caused by the admission of cooler, external air into the hollow tubular segment via the ventilation zone may have an advantageous effect on the nucleation and growth of aerosol particles.

Formation of an aerosol from a gaseous mixture containing various chemical species depends on a delicate interplay between nucleation, evaporation, and condensation, as well as coalescence, all the while accounting for variations in vapour concentration, temperature, and velocity fields. The so-called classical nucleation theory is based on the assumption that a fraction of the molecules in the gas phase are large enough to stay coherent for long times with sufficient probability (for example, a probability of one half). These molecules represent some kind of a critical, threshold molecule clusters among transient molecular aggregates, meaning that, on average, smaller molecule clusters are likely to disintegrate rather quickly into the gas phase, while larger clusters are, on average, likely to grow. Such critical cluster is identified as the key nucleation core from which droplets are expected to grow due to condensation of molecules from the vapour. It is assumed that virgin droplets that just nucleated emerge with a certain original diameter, and then may grow by several orders of magnitude. This is facilitated and may be enhanced by rapid cooling of the surrounding vapour, which induces condensation. In this connection, it helps to bear in mind that evaporation and condensation are two sides of one same mechanism, namely gas-liquid mass transfer. While evaporation relates to net mass transfer from the liquid droplets to the gas phase, condensation is net mass transfer from the gas phase to the droplet phase. Evaporation (or condensation) will make the droplets shrink (or grow), but it will not change the number of droplets.

In this scenario, which may be further complicated by coalescence phenomena, the temperature and rate of cooling can play a critical role in determining how the system responds. In general, different cooling rates may lead to significantly different temporal behaviours as concerns the formation of the liquid phase (droplets), because the nucleation process is typically nonlinear. Without wishing to be bound by theory, it is hypothesised that cooling can cause a rapid increase in the number concentration of droplets, which is followed by a strong, short-lived increase in this growth (nucleation burst). This nucleation burst would appear to be more significant at lower temperatures. Further, it would appear that higher cooling rates may favour an earlier onset of nucleation. By contrast, a reduction of the cooling rate would appear to have a favourable effect on the final size that the aerosol droplets ultimately reach.

Therefore, the rapid cooling induced by the admission of external air into the hollow tubular segment via the ventilation zone can be favourably used to favour nucleation and growth of aerosol droplets. However, at the same time, the admission of external air into the hollow tubular segment has the immediate drawback of diluting the aerosol stream delivered to the consumer.

The inventors have surprisingly found that the diluting effect on the aerosol—which can be assessed by measuring, in particular, the effect on the delivery of aerosol former (such as glycerol) included in the aerosol-generating substrate) is advantageously minimised when the ventilation level is within the ranges described above. In particular, ventilation levels between 25 percent and 50 percent, and even more preferably between 28 and 42 percent, have been found to lead to particularly satisfactory values of glycerin delivery. At the same time, the extent of nucleation and, as a consequence, the delivery of nicotine and aerosol-former (for example, glycerol) are enhanced.

The inventors have surprisingly found how the favourable effect of enhanced nucleation promoted by the rapid cooling induced by the introduction of ventilation air into the article is capable of significantly countering the less desirable effects of dilution. As such, satisfactory values of aerosol delivery are consistently achieved with aerosol-generating articles in accordance with the invention.

This is particularly advantageous with "short" aerosol-generating articles, such as ones wherein a length of the rod of aerosol-generating substrate is less than about 40 millimetres, preferably less than 25 millimetres, even more preferably less than 20 millimetres, or wherein an overall length of the aerosol-generating article is less than about 70 millimetres, preferably less than about 60 millimetres, even more preferably less than 50 millimetres. As will be appreciated, in such aerosol-generating articles, there is little time and space for the aerosol to form and for the particulate phase of the aerosol to become available for delivery to the consumer.

Further, because the ventilated hollow tubular segment substantially does not contribute to the overall RTD of the aerosol-generating article, in aerosol-generating articles in accordance with the invention the overall RTD of the article can advantageously be fine-tuned by adjusting the length and density of the rod of aerosol-generating substrate or the length and optionally the length and density of a segment of filtration material forming part of the mouthpiece or the length and density of a segment of filtration material provided upstream of the aerosol-generating substrate and the susceptor element. Thus, aerosol-generating articles that have a predetermined RTD can be manufactured consistently and with great precision, such that satisfactory levels of RTD can be provided for the consumer even in the presence of ventilation.

Alternatively or in addition to an aerosol-cooling element comprising a hollow tubular segment, the aerosol-generating article may comprise an additional cooling element defining a plurality of longitudinally extending channels such as to make a high surface area available for heat exchange. In other words, one such additional cooling element is adapted to function substantially as a heat exchanger. The plurality of longitudinally extending channels may be defined by a sheet material that has been pleated, gathered or folded to form the channels. The plurality of longitudinally extending channels may be defined by a single sheet that has been pleated, gathered or folded to form multiple channels. The sheet may also have been crimped prior to being pleated, gathered or folded. Alternatively, the plurality of longitudinally extending channels may be defined by multiple sheets that have been crimped, pleated, gathered or folded to form multiple channels. In some embodiments, the plurality of longitudinally extending channels may be defined by multiple sheets that have been crimped, pleated, gathered or folded together—that is by two or more sheets that have been brought into overlying arrangement and then crimped, pleated, gathered or folded as one. As used herein, the term 'sheet' denotes a laminar element having a width and length substantially greater than the thickness thereof.

As used herein, the term 'longitudinal direction' refers to a direction extending along, or parallel to, the cylindrical axis of a rod. As used herein, the term 'crimped' denotes a sheet having a plurality of substantially parallel ridges or corrugations. Preferably, when the aerosol-generating article has been assembled, the substantially parallel ridges or corrugations extend in a longitudinal direction with respect to the rod. As used herein, the terms 'gathered', 'pleated', or 'folded' denote that a sheet of material is convoluted, folded, or otherwise compressed or constricted substantially transversely to the cylindrical axis of the rod. A sheet may be crimped prior to being gathered, pleated or folded. A sheet may be gathered, pleated or folded without prior crimping.

One such additional cooling element may have a total surface area of between about 300 square millimetre per millimetre length and about 1000 square millimetres per millimetre length.

The additional cooling element preferably offers a low resistance to the passage of air through additional cooling element. Preferably, the additional cooling element does not substantially affect the resistance to draw of the aerosol-generating article. To achieve this, it is preferred that the porosity in a longitudinal direction is greater than 50 percent and that the airflow path through the additional cooling element is relatively uninhibited. The longitudinal porosity of the additional cooling element may be defined by a ratio of the cross-sectional area of material forming the additional cooling element and an internal cross-sectional area of the aerosol-generating article at the portion containing the additional cooling element.

The additional cooling element preferably comprises a sheet material selected from the group comprising a metallic foil, a polymeric sheet, and a substantially non-porous paper or cardboard. In some embodiments, the aerosol-cooling element may comprise a sheet material selected from the group consisting of polyethylene (PE), polypropylene (PP), polyvinylchloride (PVC), polyethylene terephthalate (PET), polylactic acid (PLA), cellulose acetate (CA), and aluminium foil. In a particularly preferred embodiment, the additional cooling element comprises a sheet of PLA.

As described above, the intermediate hollow section preferably further comprises a support element arranged in alignment with, and downstream of the rod of aerosol-generating substrate. In particular, the support element may be located immediately downstream of the rod of aerosol-generating substrate and may abut the rod of aerosol-generating substrate.

The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). In a preferred embodiment, the support element is formed from cellulose acetate. Other suitable materials include polyhydroxyalkanoate (PHA) fibres.

The support element may comprise a hollow tubular segment. In a preferred embodiment, the support element comprises a hollow cellulose acetate tube.

The support element is preferably arranged substantially in alignment with the rod. This means that the length dimension of the support element is arranged to be approximately parallel to the longitudinal direction of the rod and of the article, for example within plus or minus 10 degrees of parallel to the longitudinal direction of the rod. In preferred embodiments, the support element extends along the longitudinal axis of the rod.

The support element preferably has an outer diameter that is approximately equal to the outer diameter of the rod of aerosol-generating substrate and to the outer diameter of the aerosol-generating article.

The support element may have an outer diameter of between 5 millimetres and 12 millimetres, for example of between 5 millimetres and 10 millimetres or of between 6 millimetres and 8 millimetres. In a preferred embodiment, the support element has an external diameter of 7.2 millimetres plus or minus 10 percent.

A peripheral wall of the support element may have a thickness of at least 1 millimetre, preferably at least about 1.5 millimetres, more preferably at least about 2 millimetres.

The support element may have a length of between about 5 millimetres and about 15 millimetres.

Preferably, the support element has a length of at least about 6 millimetres, more preferably at least about 7 millimetres.

In preferred embodiments, the support element has a length of less than about 12 millimetres, more preferably less than about 10 millimetres.

In some embodiments, the support element has a length from about 5 millimetres to about 15 millimetres, preferably from about 6 millimetres to about 15 millimetres, more preferably from about 7 millimetres to about 15 millimetres. In other embodiments, the support element has a length from about 5 millimetres to about 12 millimetres, preferably from about 6 millimetres to about 12 millimetres, more preferably from about 7 millimetres to about 12 millimetres. In further embodiments, the support element has a length from about 5 millimetres to about 10 millimetres, preferably from about 6 millimetres to about 10 millimetres, more preferably from about 7 millimetres to about 10 millimetres.

In a preferred embodiment, the support element has a length of about 8 millimetres.

Preferably, the intermediate hollow section has a total length of no more than about 18 millimetres, more preferably no more than about 17 millimetres, more preferably no more than 16 millimetres.

A ratio between the length of the support element and the length of the rod of aerosol-generating substrate may be from about 0.25 to about 1.

Preferably, a ratio between the length of the support element and the length of the rod of aerosol-generating substrate is at least about 0.3, more preferably at least about 0.4, even more preferably at least about 0.5. In preferred embodiments, a ratio between the length of the support element and the length of the rod of aerosol-generating substrate is less than about 0.9, more preferably less than about 0.8, even more preferably less than about 0.7.

In some embodiments, a ratio between the length of the support element and the length of the rod of aerosol-generating substrate is from about 0.3 to about 0.9, preferably from about 0.4 to about 0.9, more preferably from about 0.5 to about 0.9. In other embodiments, a ratio between the length of the support element and the length of the rod of aerosol-generating substrate is from about 0.3 to about 0.8, preferably from about 0.4 to about 0.8, more preferably from about 0.5 to about 0.8. In further embodiments, a ratio between the length of the support element and the length of the rod of aerosol-generating substrate is from about 0.3 to about 0.7, preferably from about 0.4 to about 0.7, more preferably from about 0.5 to about 0.7.

In a particularly preferred embodiments, a ratio between the length of the support element and the length of the rod of aerosol-generating substrate is about 0.66.

A ratio between the length of the support element and the overall length of the aerosol-generating article substrate may be from about 0.125 to about 0.375.

Preferably, a ratio between the length of the support element and the overall length of the aerosol-generating article substrate is at least about 0.13, more preferably at least about 0.14, even more preferably at least about 0.15. A ratio between the length of the support element and the overall length of the aerosol-generating article substrate is preferably less than about 0.3, more preferably less than about 0.25, even more preferably less than about 0.20.

In some embodiments, a ratio between the length of the support element and the overall length of the aerosol-generating article substrate is preferably from about 0.13 to about 0.3, more preferably from about 0.14 to about 0.3, even more preferably from about 0.15 to about 0.3. In other embodiments, a ratio between the length of the support element and the overall length of the aerosol-generating article substrate is preferably from about 0.13 to about 0.25, more preferably from about 0.14 to about 0.25, even more preferably from about 0.15 to about 0.25. In further embodiments, a ratio between the length of the support element and the overall length of the aerosol-generating article substrate is preferably from about 0.13 to about 0.2, more preferably from about 0.14 to about 0.2, even more preferably from about 0.15 to about 0.2.

In a particularly preferred embodiment, a ratio between the length of the support element and the overall length of the aerosol-generating article substrate is about 0.18.

Preferably, in aerosol-generating articles in accordance with the present invention the support element has an average radial hardness of at least about 80 percent, more preferably at least about 85 percent, even more preferably at least about 90 percent. The support element is therefore able to provide a desirable level of hardness to the aerosol-generating article.

If desired, the radial hardness of the support element of aerosol-generating articles in accordance with the invention may be further increased by circumscribing the support element by a stiff plug wrap, for example, a plug wrap having a basis weight of at least about 80 grams per square metre (gsm), or at least about 100 gsm, or at least about 110 gsm.

During insertion of an aerosol-generating article in accordance with the invention into an aerosol-generating device for heating the aerosol-generating substrate, a user may be required to apply some force in order to overcome the resistance of the aerosol-generating substrate of the aerosol-generating article to insertion. This may damage one or both of the aerosol-generating article and the aerosol-generating device. In addition, the application of force during insertion of the aerosol-generating article into the aerosol-generating device may displace the aerosol-generating substrate within the aerosol-generating article. This may result in the heating element of the aerosol-generating device not being properly aligned with the susceptor element provided within the aerosol-generating substrate, which may lead to uneven and inefficient heating of the aerosol-generating substrate of the aerosol-generating article. The support element is advantageously configured to resist downstream movement of the aerosol-generating substrate during insertion of the article into the aerosol-generating device.

Preferably, the hollow tubular segment of the support element is adapted to generate a RTD between approximately 0 millimetres $H_2O$ (about 0 Pa) to approximately 20 millimetres $H_2O$ (about 100 Pa), more preferably between approximately 0 millimetres $H_2O$ (about 0 Pa) to approximately 10 millimetres $H_2O$ (about 100 Pa). The support element therefore preferably does not contribute to the overall RTD of the aerosol-generating article.

In some embodiments wherein the intermediate hollow section comprises both a support element comprising a first hollow tube segment and an aerosol-cooling element comprising a second hollow tubular segment, the internal diameter ($D_{STS}$) of the second hollow tubular segment is preferably greater than the internal diameter ($D_{FTS}$) of the first hollow tubular segment.

In more detail, a ratio between the internal diameter ($D_{STS}$) of the second hollow tubular segment and the internal diameter ($D_{FTS}$) of the first hollow tubular segment is preferably at least about 1.25. More preferably, a ratio between the internal diameter ($D_{STS}$) of the second hollow tubular segment and the internal diameter ($D_{FTS}$) of the first hollow tubular segment is preferably at least about 1.3. Even more preferably, a ratio between the internal diameter ($D_{STS}$) of the second hollow tubular segment and the internal diameter ($D_{FTS}$) of the first hollow tubular segment is preferably at least about 1.4. In particularly preferred embodiments, a ratio between the internal diameter ($D_{STS}$) of the second hollow tubular segment and the internal diameter ($D_{FTS}$) of the first hollow tubular segment is at least about 1.5, more preferably at least about 1.6.

A ratio between the internal diameter ($D_{STS}$) of the second hollow tubular segment and the internal diameter ($D_{FTS}$) of the first hollow tubular segment is preferably less than or equal to about 2.5. More preferably, a ratio between the internal diameter ($D_{STS}$) of the second hollow tubular segment and the internal diameter ($D_{FTS}$) of the first hollow tubular segment is preferably less than or equal to about 2.25. Even more preferably, ratio between the internal diameter ($D_{STS}$) of the second hollow tubular segment and the internal diameter ($D_{FTS}$) of the first hollow tubular segment is preferably less than or equal to about 2.

In some embodiments, a ratio between the internal diameter ($D_{STS}$) of the second hollow tubular segment and the internal diameter ($D_{FTS}$) of the first hollow tubular segment is from about 1.25 to about 2.5. Preferably, a ratio between the internal diameter ($D_{STS}$) of the second hollow tubular segment and the internal diameter ($D_{FTS}$) of the first hollow tubular segment is from about 1.3 to about 2.5. More preferably, a ratio between the internal diameter ($D_{STS}$) of the second hollow tubular segment and the internal diameter ($D_{FTS}$) of the first hollow tubular segment is from about 1.4 to about 2.5. In particularly preferred embodiments, a ratio between the internal diameter ($D_{STS}$) of the second hollow tubular segment and the internal diameter ($D_{FTS}$) of the first hollow tubular segment is from about 1.5 to about 2.5.

In other embodiments, a ratio between the internal diameter ($D_{STS}$) of the second hollow tubular segment and the internal diameter ($D_{FTS}$) of the first hollow tubular segment is from about 1.25 to about 2.25. Preferably, a ratio between the internal diameter ($D_{STS}$) of the second hollow tubular segment and the internal diameter ($D_{FTS}$) of the first hollow tubular segment is from about 1.3 to about 2.25. More preferably, a ratio between the internal diameter ($D_{STS}$) of the second hollow tubular segment and the internal diameter ($D_{FTS}$) of the first hollow tubular segment is from about 1.4 to about 2.25. In particularly preferred embodiments, a ratio between the internal diameter ($D_{STS}$) of the second hollow tubular segment and the internal diameter ($D_{FTS}$) of the first hollow tubular segment is from about 1.5 to about 2.25.

In further embodiments, a ratio between the internal diameter ($D_{STS}$) of the second hollow tubular segment and the internal diameter ($D_{FTS}$) of the first hollow tubular segment is from about 1.25 to about 2. Preferably, a ratio between the internal diameter ($D_{STS}$) of the second hollow tubular segment and the internal diameter ($D_{FTS}$) of the first hollow tubular segment is from about 1.3 to about 2. More preferably, a ratio between the internal diameter ($D_{STS}$) of the second hollow tubular segment and the internal diameter ($D_{FTS}$) of the first hollow tubular segment is from about 1.4 to about 2. In particularly preferred embodiments, a ratio between the internal diameter ($D_{STS}$) of the second hollow tubular segment and the internal diameter ($D_{FTS}$) of the first hollow tubular segment is from about 1.5 to about 2.

In those embodiments wherein the article further comprises an elongate susceptor element arranged longitudinally within the aerosol-generating substrate, as described below, a ratio between the internal diameter ($D_{FTS}$) of the first hollow tubular segment and a width of the susceptor element is preferably at least about 0.2. More preferably, a ratio between the internal diameter ($D_{FTS}$) of the first hollow tubular segment and a width of the susceptor element is at least about 0.3. Even more preferably, a ratio between the internal diameter ($D_{FTS}$) of the first hollow tubular segment and a width of the susceptor element is at least about 0.4.

In addition, or as an alternative, a ratio between the internal diameter ($D_{STS}$) of the second hollow tubular segment and a width of the susceptor element is preferably at least about 0.2. More preferably, a ratio between the internal diameter ($D_{STS}$) of the second hollow tubular segment and a width of the susceptor element is at least about 0.5. Even more preferably, a ratio between the internal diameter ($D_{STS}$) of the second hollow tubular segment and a width of the susceptor element is at least about 0.8.

Preferably, a ratio between a volume of the cavity of the first hollow tubular segment and a volume of the cavity of the second hollow tubular segment is at least about 0.1. More preferably, a ratio between a volume of the cavity of the first hollow tubular segment and a volume of the cavity of second hollow tubular segment is at least about 0.2. Even more preferably, a ratio between a volume of the cavity of first hollow tubular segment and a volume of the cavity of second hollow tubular segment is at least about 0.3.

A ratio between a volume of the cavity of the first hollow tubular segment and a volume of the cavity of the second hollow tubular segment is preferably less than or equal to about 0.9. More preferably, a ratio between a volume of the cavity of the first hollow tubular segment and a volume of the cavity of the second hollow tubular segment is preferably less than or equal to about 0.7. Even more preferably, a ratio between a volume of the cavity of the first hollow tubular segment and a volume of the cavity of the second hollow tubular segment is preferably less than or equal to about 0.5.

The aerosol-generating article according to the present invention may have a length from about 35 millimetres to about 100 millimetres.

Preferably, an overall length of an aerosol-generating article in accordance with the invention is at least about 38 millimetres. More preferably, an overall length of an aerosol-generating article in accordance with the invention is at least about 40 millimetres. Even more preferably, an overall length of an aerosol-generating article in accordance with the invention is at least about 42 millimetres.

An overall length of an aerosol-generating article in accordance with the invention is preferably less than or equal to 70 millimetres. More preferably, an overall length of an aerosol-generating article in accordance with the invention is preferably less than or equal to 60 millimetres. Even more preferably, an overall length of an aerosol-generating article in accordance with the invention is preferably less than or equal to 50 millimetres.

In some embodiments, an overall length of the aerosol-generating article is preferably from about 38 millimetres to about 70 millimetres, more preferably from about 40 millimetres to about 70 millimetres, even more preferably from about 42 millimetres to about 70 millimetres. In other embodiments, an overall length of the aerosol-generating article is preferably from about 38 millimetres to about 60 millimetres, more preferably from about 40 millimetres to about 60 millimetres, even more preferably from about 42 millimetres to about 60 millimetres. In further embodiments, an overall length of the aerosol-generating article is preferably from about 38 millimetres to about 50 millimetres, more preferably from about 40 millimetres to about 50 millimetres, even more preferably from about 42 millimetres to about 50 millimetres. In an exemplary embodiment, an overall length of the aerosol-generating article is about 45 millimetres.

The aerosol-generating article preferably has an external diameter of at least 5 millimetres. Preferably, the aerosol-generating article has an external diameter of at least 6 millimetres. More preferably, the aerosol-generating article has an external diameter of at least 7 millimetres.

Preferably, the aerosol-generating article has an external diameter of less than or equal to about 12 millimetres. More preferably, the aerosol-generating article has an external diameter of less than or equal to about 10 millimetres. Even more preferably, the aerosol-generating article has an external diameter of less than or equal to about 8 millimetres.

In some embodiments, the aerosol-generating article has an external diameter from about 5 millimetres to about 12 millimetres, preferably from about 6 millimetres to about 12 millimetres, more preferably from about 7 millimetres to about 12 millimetres. In other embodiments, the aerosol-generating article has an external diameter from about 5 millimetres to about 10 millimetres, preferably from about 6 millimetres to about 10 millimetres, more preferably from about 7 millimetres to about 10 millimetres. In further embodiments, the aerosol-generating article has an external diameter from about 5 millimetres to about 8 millimetres, preferably from about 6 millimetres to about 8 millimetres, more preferably from about 7 millimetres to about 8 millimetres.

In certain preferred embodiments of the invention, a diameter ($D_{ME}$) of the aerosol-generating article at the mouth end is (preferably) greater than a diameter ($D_{DE}$) of the aerosol-generating article at the distal end. In more detail, a ratio ($D_{ME}/D_{DE}$) between the diameter of the aerosol-generating article at the mouth end and the diameter of the aerosol-generating article at the distal end is (preferably) at least about 1.005.

Preferably, a ratio ($D_{ME}/D_{DE}$) between the diameter of the aerosol-generating article at the mouth end and the diameter of the aerosol-generating article at the distal end is (preferably) at least about 1.01. More preferably, a ratio ($D_{ME}/D_{DE}$) between the diameter of the aerosol-generating article at the mouth end and the diameter of the aerosol-generating article at the distal end is at least about 1.02. Even more preferably, a ratio ($D_{ME}/D_{DE}$) between the diameter of the aerosol-generating article at the mouth end and the diameter of the aerosol-generating article at the distal end is at least about 1.05.

A ratio ($D_{ME}/D_{DE}$) between the diameter of the aerosol-generating article at the mouth end and the diameter of the aerosol-generating article at the distal end is preferably less than or equal to about 1.30. More preferably, a ratio ($D_{ME}/D_{DE}$) between the diameter of the aerosol-generating article at the mouth end and the diameter of the aerosol-generating article at the distal end is less than or equal to about 1.25. Even more preferably, a ratio ($D_{ME}/D_{DE}$) between the diameter of the aerosol-generating article at the mouth end and the diameter of the aerosol-generating article at the distal end is less than or equal to about 1.20. In particularly preferred embodiments, a ratio ($D_{ME}/D_{DE}$) between the diameter of the aerosol-generating article at the mouth end and the diameter of the aerosol-generating article at the distal end is less than or equal to 1.15 or 1.10.

In some preferred embodiments, a ratio ($D_{ME}/D_{DE}$) between the diameter of the aerosol-generating article at the mouth end and the diameter of the aerosol-generating article at the distal end is from about 1.01 to 1.30, more preferably from 1.02 to 1.30, even more preferably from 1.05 to 1.30.

In other embodiments, a ratio ($D_{ME}/D_{DE}$) between the diameter of the aerosol-generating article at the mouth end and the diameter of the aerosol-generating article at the distal end is from about 1.01 to 1.25, more preferably from 1.02 to 1.25, even more preferably from 1.05 to 1.25. In further embodiments, a ratio ($D_{ME}/D_{DE}$) between the diameter of the aerosol-generating article at the mouth end and the diameter of the aerosol-generating article at the distal end is from about 1.01 to 1.20, more preferably from 1.02 to 1.20, even more preferably from 1.05 to 1.20. In yet further embodiments, a ratio ($D_{ME}/D_{DE}$) between the diameter of the aerosol-generating article at the mouth end and the diameter of the aerosol-generating article at the distal end is from about 1.01 to 1.15, more preferably from 1.02 to 1.15, even more preferably from 1.05 to 1.15.

By way of example, the external diameter of the article may be substantially constant over a distal portion of the article extending from the distal end of the aerosol-generating article for at least about 5 millimetres or at least about 10 millimetres. As an alternative, the external diameter of the article may taper over a distal portion of the article extending from the distal end for at least about 5 millimetres or at least about 10 millimetres.

In certain preferred embodiments of the present invention, the elements of the aerosol-generating article, as described above, are arranged such that the centre of mass of the aerosol-generating article is at least about 60 percent of the way along the length of the aerosol-generating article from the downstream end. More preferably, the elements of the aerosol-generating article are arranged such that the centre of mass of the aerosol-generating article is at least about 62 percent of the way along the length of the aerosol-generating article from the downstream end, more preferably at least about 65 percent of the way along the length of the aerosol-generating article from the downstream end.

Preferably, the centre of mass is no more than about 70 percent of the way along the length of the aerosol-generating article from the downstream end.

Providing an arrangement of elements that gives a centre of mass that is closer to the upstream end than the downstream end results in an aerosol-generating article having a weight imbalance, with a heavier upstream end. This weight imbalance may advantageously provide haptic feedback to the consumer to enable them to distinguish between the upstream and downstream ends so that the correct end can be inserted into an aerosol-generating device. This may be particularly beneficial where an upstream element is provided such that the upstream and downstream ends of the aerosol-generating article are visually similar to each other.

In embodiments of aerosol-generating articles in accordance with the invention, wherein both aerosol-cooling element and support element are present, these are preferably wrapped together in a combined wrapper. The combined wrapper circumscribes the aerosol-cooling element and the support element, but does not circumscribe a further downstream, such as a mouthpiece element.

In these embodiments, the aerosol-cooling element and the support element are combined prior to being circumscribed by the combined wrapper, before they are further combined with the mouthpiece segment.

From a manufacturing viewpoint, this is advantageous in that it enables shorter aerosol-generating articles to be assembled.

In general, it may be difficult to handle individual elements that have a length smaller than their diameter. For example, for elements with a diameter of 7 millimetres, a length of about 7 millimetres represents a threshold value close to which it is preferable not to go. However, an aerosol-cooling element of 10 millimetres can be combined with a pair of support elements of 7 millimetres on each side (and potentially with other elements like the rod of aerosol-generating substrate, etc.) to provide a hollow segment of 24 millimetres, which is subsequently cut into two intermediate hollow sections of 12 millimetres.

In particularly preferred embodiments, the other components of the aerosol-generating article are individually circumscribed by their own wrapper. In other words, the upstream element, the rod of aerosol-generating substrate, the support element, and the aerosol-cooling element are all individually wrapped. The support element and the aerosol-cooling element are combined to form the intermediate hollow section. This is achieved by wrapping the support element and the aerosol-cooling element by means of a combined wrapper. The upstream element, the rod of aerosol-generating substrate, and the intermediate hollow section are then combined together with an outer wrapper. Subsequently, they are combined with the mouthpiece element—which has a wrapper of its own—by means of tipping paper.

Preferably, at least one of the components of the aerosol-generating article is wrapped in a hydrophobic wrapper.

The term "hydrophobic" refers to a surface exhibiting water repelling properties. One useful way to determine this is to measure the water contact angle. The "water contact angle" is the angle, conventionally measured through the liquid, where a liquid/vapour interface meets a solid surface. It quantifies the wettability of a solid surface by a liquid via the Young equation. Hydrophobicity or water contact angle may be determined by utilizing TAPPI T558 test method and the result is presented as an interfacial contact angle and reported in "degrees" and can range from near zero to near 180 degrees.

In preferred embodiments, the hydrophobic wrapper is one including a paper layer having a water contact angle of about 30 degrees or greater, and preferably about 35 degrees or greater, or about 40 degrees or greater, or about 45 degrees or greater.

By way of example, the paper layer may comprise PVOH (polyvinyl alcohol) or silicon. The PVOH may be applied to the paper layer as a surface coating, or the paper layer may comprise a surface treatment comprising PVOH or silicon.

In a particularly preferred embodiment, an aerosol-generating article in accordance with the present invention comprises, in linear sequential arrangement, an upstream element, a rod of aerosol-generating substrate located immediately downstream of the upstream element, a support element located immediately downstream of the rod of aerosol-generating substrate, an aerosol-cooling element located immediately downstream of the support element, a mouthpiece element located immediately downstream of the aerosol-cooling element, and an outer wrapper circumscribing the upstream element, the support element, the aerosol-cooling element and the mouthpiece element.

In more detail, the rod of aerosol-generating substrate may abut the upstream element. The support element may abut the rod of aerosol-generating substrate. The aerosol-cooling element may abut the support element. The mouthpiece element may abut the aerosol-cooling element.

The aerosol-generating article has a substantially cylindrical shape and an outer diameter of about 7.25 millimetres.

The upstream element has a length of about 5 millimetres, the rod of aerosol-generating article has a length of about 12 millimetres, the support element has a length of about 8 millimetres, the mouthpiece element has a length of about 12 millimetres. Thus, an overall length of the aerosol-generating article is about 45 millimetres.

The upstream element is in the form of a plug of cellulose acetate wrapped in stiff plug wrap.

The aerosol-generating article comprises an elongate susceptor element arranged substantially longitudinally within the rod of aerosol-generating substrate and is in thermal contact with the aerosol-generating substrate. The susceptor element is in the form of a strip or blade, has a length substantially equal to the length of the rod of aerosol-generating substrate and a thickness of about 60 micrometres.

The support element is in the form of a hollow cellulose acetate tube and has an internal diameter of about 1.9 millimetres. Thus, a thickness of a peripheral wall of the support element is about 2.675 millimetres.

The aerosol-cooling element is in the form of a finer hollow cellulose acetate tube and has an internal diameter of about 3.25 millimetres. Thus, a thickness of a peripheral wall of the aerosol-cooling element is about 2 millimetres.

The mouthpiece element is in the form of a low-density cellulose acetate filter segment.

The rod of aerosol-generating substrate comprises an aerosol-generating substrate comprising a gel composition.

Figure 2:
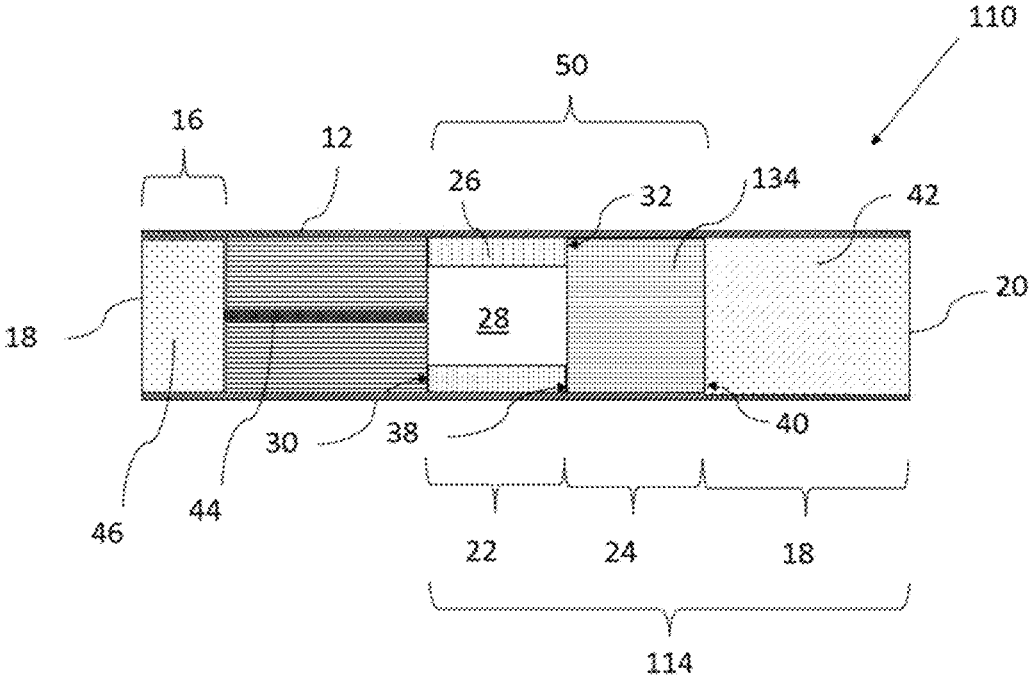

In the following, the invention will be further described with reference to the drawings of the accompanying Figures, wherein:

FIG. 1 shows a schematic side sectional view of an aerosol-generating article in accordance with the invention; and FIG. 2 shows a schematic side sectional view of another aerosol-generating article in accordance with the invention.

The aerosol-generating article 10 shown in FIG. 1 comprises a rod 12 of aerosol-generating substrate and a downstream section 14 at a location downstream of the rod 12 of aerosol-generating substrate. Further, the aerosol-generating article 10 comprises an upstream section 16 at a location upstream of the rod 12 of aerosol-generating substrate. Thus, the aerosol-generating article 10 extends from an upstream or distal end 18 to a downstream or mouth end 20.

The aerosol-generating article has an overall length of about 45 millimetres.

The downstream section 14 comprises a support element 22 located immediately downstream of the rod 12 of aerosol-generating substrate, the support element 22 being in longitudinal alignment with the rod 12. In the embodiment of FIG. 1, the upstream end of the support element 22 abuts the downstream end of the rod 12 of aerosol-generating substrate. In addition, the downstream section 14 comprises an aerosol-cooling element 24 located immediately downstream of the support element 22, the aerosol-cooling element 24 being in longitudinal alignment with the rod 12 and the support element 22. In the embodiment of FIG. 1, the upstream end of the aerosol-cooling element 24 abuts the downstream end of the support element 22.

As will become apparent from the following description, the support element 22 and the aerosol-cooling element 24 together define an intermediate hollow section 50 of the aerosol-generating article 10. As a whole, the intermediate hollow section 50 does not substantially contribute to the overall RTD of the aerosol-generating article. An RTD of the intermediate hollow section 50 as a whole is substantially 0 millimetres $H_2O$.

The support element 22 comprises a first hollow tubular segment 26. The first hollow tubular segment 26 is provided in the form of a hollow cylindrical tube made of cellulose acetate. The first hollow tubular segment 26 defines an internal cavity 28 that extends all the way from an upstream end 30 of the first hollow tubular segment to a downstream end 32 of the first hollow tubular segment 26. The internal cavity 28 is substantially empty, and so substantially unrestricted airflow is enabled along the internal cavity 28. The first hollow tubular segment 26—and, as a consequence, the support element 22—does not substantially contribute to the overall RTD of the aerosol-generating article 10. In more detail, the RTD of the first hollow tubular segment 26 (which is essentially the RTD of the support element 22) is substantially 0 millimetres $H_2O$.

The first hollow tubular segment 26 has a length of about 8 millimetres, an external diameter of about 7.25 millimetres, and an internal diameter ($D_{FTS}$) of about 1.9 millimetres. Thus, a thickness of a peripheral wall of the first hollow tubular segment 26 is about 2.67 millimetres.

The aerosol-cooling element 24 comprises a second hollow tubular segment 34. The second hollow tubular segment 34 is provided in the form of a hollow cylindrical tube made of cellulose acetate. The second hollow tubular segment 34 defines an internal cavity 36 that extends all the way from an upstream end 38 of the second hollow tubular segment to a downstream end 40 of the second hollow tubular segment 34. The internal cavity 36 is substantially empty, and so substantially unrestricted airflow is enabled along the internal cavity 36. The second hollow tubular segment 34—and, as a consequence, the aerosol-cooling element 24—does not substantially contribute to the overall RTD of the aerosol-generating article 10. In more detail, the RTD of the second hollow tubular segment 34 (which is essentially the RTD of the aerosol-cooling element 24) is substantially 0 millimetres $H_2O$.

The second hollow tubular segment 34 has a length of about 8 millimetres, an external diameter of about 7.25 millimetres, and an internal diameter ($D_{STS}$) of about 3.25 millimetres. Thus, a thickness of a peripheral wall of the second hollow tubular segment 34 is about 2 millimetres. Thus, a ratio between the internal diameter ($D_{FTS}$) of the first hollow tubular segment 26 and the internal diameter ($D_{STS}$) of the second hollow tubular segment 34 is about 0.75.

The aerosol-generating article 10 comprises a ventilation zone 60 provided at a location along the second hollow tubular segment 34. In more detail, the ventilation zone is provided at about 2 millimetres from the upstream end 38 of the second hollow tubular segment 34. A ventilation level of the aerosol-generating article 10 is about 25 percent.

In the embodiment of FIG. 1, the downstream section 14 further comprises a mouthpiece element 42 at a location downstream of the intermediate hollow section 50. In more detail, the mouthpiece element 42 is positioned immediately downstream of the aerosol-cooling element 24. As shown in the drawing of FIG. 1, an upstream end of the mouthpiece element 42 abuts the downstream end 40 of the aerosol-cooling element 24.

The mouthpiece element 42 is provided in the form of a cylindrical plug of low-density cellulose acetate.

The mouthpiece element 42 has a length of about 12 millimetres and an external diameter of about 7.25 millimetres. The RTD of the mouthpiece element 42 is about 12 millimetres $H_2O$.

The rod 12 comprises an aerosol-generating substrate comprising a porous medium loaded with a gel composition as defined above. An example of a suitable gel composition is shown below in Table 1:

TABLE 1

| Gel composition | |
|---|---|
| Component | Amount (% by weight) |
| Water | 20 |
| Glycerol | 73.5 |
| Nicotine | 1.5 |
| Gelling agent | 3 |
| Lactic acid | 1 |
| Divalent cations | 1 |

The rod 12 of aerosol-generating substrate has an external diameter of about 7.25 millimetres and a length of about 12 millimetres.

The aerosol-generating article 10 further comprises an elongate susceptor element 44 within the rod 12 of aerosol-generating substrate. In more detail, the susceptor element 44 is arranged substantially longitudinally within the aerosol-generating substrate, such as to be approximately parallel to the longitudinal direction of the rod 12. As shown in the drawing of FIG. 1, the susceptor element 44 is positioned in a radially central position within the rod and extends effectively along the longitudinal axis of the rod 12.

The susceptor element 44 extends all the way from an upstream end to a downstream end of the rod 12. In effect, the susceptor element 44 has substantially the same length as the rod 12 of aerosol-generating substrate.

In the embodiment of FIG. 1, the susceptor element 44 is provided in the form of a strip and has a length of about 12 millimetres, a thickness of about 60 micrometres, and a width of about 4 millimetres. The upstream section 16 comprises an upstream element 46 located immediately upstream of the rod 12 of aerosol-generating substrate, the upstream element 46 being in longitudinal alignment with the rod 12. In the embodiment of FIG. 1, the downstream end of the upstream element 46 abuts the upstream end of the rod 12 of aerosol-generating substrate. This advantageously prevents the susceptor element 44 from being dislodged. Further, this ensures that the consumer cannot accidentally contact the heated susceptor element 44 after use.

The upstream element 46 is provided in the form of a cylindrical plug of cellulose acetate circumscribed by a stiff wrapper. The upstream element 46 has a length of about 5 millimetres. The RTD of the upstream element 46 is about 30 millimetres $H_2O$.

The aerosol-generating article 110 shown in FIG. 2 has substantially the same overall structure of the aerosol-generating article 10 of FIG. 1, and will be described below insofar as it differs from the aerosol-generating article 10.

As shown in FIG. 2, the aerosol-generating article 110 comprises a rod 12 of aerosol-generating substrate 12 and a modified downstream section 114 at a location downstream of the rod 12 of aerosol-generating substrate. Further, the aerosol-generating article 10 comprises an upstream section 16 at a location upstream of the rod 12 of aerosol-generating substrate.

Like the downstream section 14 of the aerosol-generating article 10, the modified downstream section 114 of the aerosol-generating article 110 comprises a support element 22 located immediately downstream of the rod 12 of aerosol-generating substrate, the support element 22 being in longitudinal alignment with the rod 12, wherein the upstream end of the support element 22 abuts the downstream end of the rod 12 of aerosol-generating substrate.

Further, the modified downstream section 114 comprises an aerosol-cooling element 134 located immediately downstream of the support element 22, the aerosol-cooling element 134 being in longitudinal alignment with the rod 12 and the support element 22. In more detail, the upstream end of the aerosol-cooling element 134 abuts the downstream end of the support element 22.

In contrast to downstream section 14 of the aerosol-generating article 10, the aerosol-cooling element 134 of the modified downstream section 114 comprises a plurality of longitudinally extending channels which offer a low or substantially null resistance to the passage of air through the rod. In more detail, the aerosol-cooling element 134 is formed from a preferably non-porous sheet material selected from the group comprising a metallic foil, a polymeric sheet, and a substantially non-porous paper or cardboard. In particular, in the embodiment illustrated in FIG. 2, the aerosol-cooling element 134 is provided in the form of a crimped and gathered sheet of polylactic acid (PLA). The aerosol-cooling element 134 has a length of about 8 millimetres, and an external diameter of about 7.25 millimetres.

The invention claimed is:

1. An aerosol-generating article for producing an inhalable aerosol upon heating, the aerosol-generating article comprising:

a rod of aerosol-generating substrate comprising a gel composition, the gel composition comprising at least one gelling agent, at least one of an alkaloid compound and a cannabinoid compound, and an aerosol former;

an upstream element upstream of the rod of aerosol-generating substrate and abutting an upstream end of the rod of aerosol-generating substrate, wherein a resistance-to-draw (RTD) of the upstream element is between 5 millimetres $H_2O$ and 80 millimetres $H_2O$;

a downstream section arranged downstream of the rod of aerosol-generating substrate and in axial alignment with the rod of aerosol-generating substrate, the downstream section comprising one or more downstream elements; and a susceptor element within the rod of aerosol-generating substrate, wherein the upstream element is upstream of the susceptor element.

2. The aerosol-generating article according to claim 1, wherein the susceptor element extends from the upstream end of the rod of aerosol-generating substrate to a downstream end of the rod of aerosol-generating substrate.

3. The aerosol-generating article according to claim 1, wherein the rod of aerosol-generating substrate further comprises a plug of a porous medium loaded with the gel composition.

4. The aerosol-generating article according to claim 3, wherein the porous medium is in the form of a crimped sheet.

5. The aerosol-generating article according to claim 3, wherein the porous medium comprises cotton fibres.

6. The aerosol-generating article according to claim 3, wherein the plug of the porous medium loaded with the gel composition is circumscribed by a water repellent wrapper.

7. The aerosol-generating article according to claim 1, wherein the gel composition further comprises at least 1 percent by weight of nicotine.

8. The aerosol-generating article according to claim 1, wherein the gel composition further comprises an acid.

9. The aerosol-generating article according to claim 1, wherein the gel composition further comprises between 1 percent by weight and 6 percent by weight of the at least one gelling agent.

10. The aerosol-generating article according to claim 1, wherein the susceptor element is an elongated susceptor element extending in a longitudinal direction through the rod of aerosol-generating substrate.

11. The aerosol-generating article according to claim 1, wherein the upstream element comprises a plug of fibrous filtration material.

12. The aerosol-generating article according to claim 1, wherein the RTD of the upstream element is at least 20 millimetres $H_2O$.

13. The aerosol-generating article according to claim 1, wherein the downstream section comprises a mouthpiece element comprising a mouthpiece filter segment formed of a fibrous filtration material.

14. The aerosol-generating article according to claim 13, wherein the RTD of the upstream element is at least 1.5 times a RTD of the mouthpiece element.

15. The aerosol-generating article according to claim 13, wherein the downstream section comprises an intermediate hollow section between the rod of aerosol-generating substrate and the mouthpiece element, the intermediate hollow section comprising an aerosol-cooling element abutting an upstream end of the mouthpiece element, the aerosol-cooling element comprising a hollow tubular segment defining a longitudinal cavity providing an unrestricted flow channel.

16. The aerosol-generating article according to claim 15, wherein the intermediate hollow section further comprises a support element between the aerosol-cooling element and the rod of aerosol-generating substrate, the support element comprising a hollow tubular segment defining a longitudinal cavity providing an unrestricted flow channel.

17. The aerosol-generating article according to claim 1, wherein the downstream section comprises a mouthpiece element located at a downstream end of the aerosol-generating article, and wherein the mouthpiece element has a RTD of less than 25 millimetres $H_2O$.

* * * * *